US006802589B2

(12) United States Patent
Yonekubo et al.

(10) Patent No.: US 6,802,589 B2
(45) Date of Patent: Oct. 12, 2004

(54) LIQUID-JETTING APPARATUS AND METHOD OF DRIVING THE SAME

(75) Inventors: Shuji Yonekubo, Nagano-Ken (JP); Junhua Chang, Nagano-Ken (JP); Keiji Matsumoto, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 5 days.

(21) Appl. No.: 10/229,262

(22) Filed: Aug. 28, 2002

(65) Prior Publication Data

US 2003/0058302 A1 Mar. 27, 2003

(30) Foreign Application Priority Data

| | | |
|---|---|---|
| Aug. 29, 2001 | (JP) | 2001-259638 |
| Dec. 28, 2001 | (JP) | 2001-398899 |
| Jan. 15, 2002 | (JP) | 2002-006066 |
| Feb. 21, 2002 | (JP) | 2002-044851 |
| Jul. 5, 2002 | (JP) | 2002-197447 |

(51) Int. Cl.[7] ..... B41J 2/165

(52) U.S. Cl. ..... 347/29; 347/10; 347/14; 347/23

(58) Field of Search ..... 347/35, 10, 11, 347/14, 23, 24, 27, 29, 34

(56) References Cited

U.S. PATENT DOCUMENTS

| | | | | |
|---|---|---|---|---|
| 6,036,299 A | * | 3/2000 | Kobayashi et al. | 347/30 |
| 6,467,865 B1 | * | 10/2002 | Iwamura et al. | 347/14 |

FOREIGN PATENT DOCUMENTS

| | | |
|---|---|---|
| EP | 0 788 882 A2 | 8/1997 |
| EP | 1 000 743 A2 | 5/2000 |
| EP | 1 034 934 A2 | 9/2000 |

* cited by examiner

*Primary Examiner*—Shih-Wen Hsieh
(74) *Attorney, Agent, or Firm*—Sughrue Mion, PLLC

(57) ABSTRACT

The liquid-jetting apparatus has a liquid-jetting head with nozzle openings through which liquid particles are jetted. The liquid-jetting head performs a flushing operation to remove the thickened liquid from the nozzle openings to recover its normal liquid-jetting ability. The flushing operation jets liquid particles having a weight of 10 ng or below successively through the nozzle openings at a jetting speed of 8 m/s or above. The liquid-jetting apparatus is capable of achieving a satisfactory flushing operation to ensure a satisfactory liquid-jetting characteristic by recovering from a thickened state in a liquid in the nozzle openings even if the liquid is un-uniformly thickened in the nozzle openings.

55 Claims, 13 Drawing Sheets

LIQUID-JETTING APPARATUS AND METHOD OF DRIVING THE SAME

BACKGROUND OF THE INVENTION

1. Field of the Invention

The present invention relates to a liquid-jetting apparatus including a liquid-jetting head provided with nozzle openings through which liquid particles are jetted, and a method of driving the liquid-jetting apparatus.

2. Description of the Related Art

An ink-jet recording apparatus, such as an ink-jet printer or plotter, is a representative example of a liquid-jetting apparatus. The ink-jet recording apparatus moves a recording head, i.e., a liquid-jetting head, in a scanning direction, moves a recording sheet (printable recording medium) in a feed direction, jets ink particles through the nozzle openings of the recording head as the recording head is moved in the scanning direction to print images (characters) on a recording sheet. Ink particles (liquid particles) are jetted, for example, by changing the pressure of the ink in pressure chambers communicating with the nozzle openings, respectively.

The pressure of the ink is changed by a pressure-generating element, such as a piezoelectric vibrator (piezoelectric member). The piezoelectric vibrator is transformed when a driving pulse is applied thereto to change the volume of the pressure chamber. Consequently, the pressure of the ink contained in the pressure chamber changes to jet an ink particle through the nozzle opening.

Since the ink in the nozzle openings of the recording head is exposed to the atmosphere, the solvent, such as water, of the ink evaporates gradually and the viscosity of the ink in the nozzle openings increases, which deteriorates the image quality of recorded images. When the viscosity of the ink filling the nozzle opening is excessively high, it is possible that an ink particle jetted through the nozzle opening deviates from a normal direction.

Therefore, measures are taken for the ink-jet recording apparatus to prevent increase in the viscosity of the ink filling the nozzle openings. The measures include a flushing operation for forcibly jetting the ink having an increased viscosity to a non-recording region outside a recording region or a stirring operation for stirring the ink by vibrating meniscus of the ink. The meniscus is the exposed free surface of the ink in the nozzle opening.

The conventional flushing operation uses a jetting waveform included in a driving signal which is also used for jetting an ink particle for a recording operation.

Generally, a driving signal for driving an ink-jet device to jet an ink particle for recording has a first voltage-raising part to apply a voltage to the piezoelectric member such that the pressure chamber is expanded and the pressure in the pressure chamber is reduced to a reduced pressure, a first voltage holding part to apply a voltage to the piezoelectric member such that the pressure chamber is maintained at the reduced pressure, a first voltage-reducing part to apply a voltage to the piezoelectric member such that the pressure chamber is contracted and the pressure in the pressure chamber is raised to a raised pressure, a second voltage holding part to apply a voltage to the piezoelectric member such that the pressure chamber is maintained at the raised pressure, and a second voltage-raising part to apply a voltage to the piezoelectric member such that the pressure chamber is restored to its original state.

Generally, ink particles including those for the flushing operation are jetted at a jetting speed on the order of 7 m/s, and the weight of the ink particles is, for example, 13 ng.

Usually, parts of the recording head corresponding to the nozzle openings are covered with a cap.

The inventors of the present invention acquired knowledge that it is possible that thickenings of lines or failure in forming dots occurs during printing after removing the cap if the ink has a high pigment concentration. The thickening of lines and failure in forming dots occur when bubbles are formed in the nozzle openings. The inventors of the present invention made the following analytical studies to find what forms bubbles in the nozzle opening.

The solvent, such as water, of the ink filling the nozzle opening covered with a cap and forming a meniscus evaporates and the viscosity of the ink increases. An ink particle jetted through the nozzle opening deviates from a normal direction or the nozzle opening is clogged with the ink if the viscosity of the ink is thus increased.

Increase in the viscosity of the ink starts from a peripheral part of the nozzle opening. Whereas the viscosity of the ink in a peripheral part of the meniscus started to increase in about two minutes after the nozzle opening has been covered with the cap, the viscosity of the ink in a central did not start to increase in about five minutes after the nozzle opening has been covered with the cap. Thus, the viscosity of the ink forming the meniscus increases un-uniformly in a period of two to five minutes after the nozzle opening has been covered with the cap.

An ordinary flushing operation applies pressure to the ink so that the entire meniscus is pushed out of the nozzle opening as shown in FIG. 9(*b*). Therefore, if the viscosity of the ink in a peripheral part of the nozzle opening and that of the ink in a central part of the nozzle opening are differently increased, the meniscus is un-uniformly deformed by the flushing operation and the meniscus is liable to break. If the flushing operation is continued with the meniscus in an easily breakable state, it is highly possible that the ink adheres to the periphery of the outlet of the nozzle opening, the meniscus is broken and, eventually, bubbles are formed in the ink.

Actually, printing troubles, such as the thickening of printed lines and failure in printing dots, occur only in two to five minutes after the nozzle openings have been covered with the cap.

Therefore, when the viscosity of the ink forming the meniscus is expected to be un-uniformly increased, the flushing operation must supply energy sufficient to overcome the strength of a film of the ink having the increased viscosity to the ink filling a central part of the nozzle opening to jet an ink particle, and the flushing operation must be continued to remove gradually the ink having the increased viscosity forming the peripheral part of the meniscus.

The conventional flushing operation uses large ink particles that are jetted during a printing operation for printing large dots and are capable of exerting a large force enough to blow off the ink of the increased viscosity to achieve flushing in a short time. The term "large dot" signifies the largest dot that can be formed by the relevant ink-jet recording apparatus.

It was found that particles of some ink jetted immediately after the completion of the flushing operation are subject to so called "wet deviation" and reduces printing accuracy if large ink particles are jetted for the flushing operation. The term "wet deviation" signifies the deviation of a jetted ink particle from a normal flying direction due to the drawing effect of the ink adhered to the periphery of the outlet of the nozzle opening during the preceding flushing operation on the jetted ink particle.

The occurrence of wet deviation immediately after the flushing operation may be due to the adhesion of a mist of the ink generated during the flushing operation that jets large ink particles to the periphery of the outlet end of the nozzle opening.

An ink having a high pigment concentration and prone to thicken has a tendency to cause wet deviation immediately after the flushing operation.

Recently, inks having a high pigment concentration have been developed. The use of such an ink having a high pigment concentration will make wet deviation immediately after the flushing operation more serious.

For example, experiment showed that wet deviation occurs when the flushing operation is started after an interval of one second or longer from an ink-jetting cycle preceding the flushing operation if the flushing operation that jets large ink particles uses an ink having a high pigment concentration of ten-odd percent; that is wet deviation occurs inevitably unless the flushing operation that jets large ink particles is started within one second after the preceding ink-jetting cycle, when an ink having a pigment concentration of ten-odd percent is used. The execution of the flushing operation within such a short time after the preceding ink-jetting cycle is practically very difficult or impossible.

Another flushing operation may jet a small ink particle for forming a small dot through the nozzle opening to prevent wet deviation.

However, if an ink that thickens at a high rate is jetted in a small ink particle for the flushing operation, it is possible that some part of the thickened ink remains in the nozzle opening. Moreover, the flushing operation that jets a small ink particle needs a long time. Such a small ink particle is light and is easy to change into a mist. For example, it is possible that a small ink particle changes into a mist, and the mist wets the periphery of the outlet end of the nozzle opening to cause wet deviation, when the distance between the surface, in which the outlets of nozzle openings lie, of a recording head and a member on which an ink particle jetted for the flushing operation falls, such as the surface, on which the ink particle falls, of a cap that covers the surface of the recording head in a non-recording region outside a recording region is relatively long.

Generally, conventional ink-jet recording apparatuses have a function to perform a cleaning operation to remove the ink solidified in the nozzle openings and clogging the nozzle openings and to stop faulty ink jetting attributable to bubbles mixed in the ink in a ink supply passage by covering the surface, in which the nozzle openings open, of the recording head with a capping means and removing the ink from the nozzle openings by suction exerted by a vacuum pump (tube pump), when the nozzle openings are clogged or the ink cartridge is changed.

In this cleaning operation, inks of different colors jetted into the capping means mix together to produce a mixed ink, and the mixed ink adheres to the nozzle openings. Therefore, the conventional ink-jet recording apparatuses perform the flushing operation after the cleaning operation to remove the mixed ink adhering to the nozzle openings. In this flushing operation, ink-jetting pulse signals that are used for making the nozzle openings jet the ink for a printing operation are given to pressurizing members to jet ink particles through the nozzle openings into the non-recording region outside the recording region.

As mentioned above, the conventional flushing operation jets a large ink particle, which is used for forming a large dot by the printing operation, to complete the flushing operation in a short time. An ink-jet recording apparatus capable of changing the frequency of a driving signal to be applied to a pressure-generating element uses a high-frequency driving signal for the flushing operation to reduce time necessary for the flushing operation.

If a large ink particle is jetted for the flushing operation by driving the pressure-generating element by a high-frequency driving signal, it is possible that the meniscus of the ink in the nozzle opening is broken, causing faulty printing, such as failure in properly printing dots. Even after the completion of the cleaning operation, minute bubbles remains in the ink in the nozzle opening and minute bubbles adhere to a part of the wall of the nozzle opening. If the flushing operation using large ink particles is performed under the condition that minute bubbles remain on the wall of the nozzle opening, the meniscus is liable to catch the bubbles because the meniscus is retracted greatly during the flushing operation when a large ink particle is used for the flushing operation. The residual bubbles caught by the meniscus are liable to break the meniscus. Since the meniscus is slightly deformed after the cleaning operation, the jetting characteristic becomes unstable if the flushing operation uses the high-frequency driving signal, which also can be a cause of breakage of the meniscus.

SUMMARY OF THE INVENTION

The present invention has been made in view of the foregoing circumstances and it is therefore an object of the present invention to provide an ink-jet recording apparatus, more broadly, a liquid-jetting apparatus, capable of satisfactorily carrying out an operation of preventing the ink forming a meniscus from thickening to maintain a satisfactory ink-jetting characteristic even if the ink forming a meniscus is thickened un-uniformly.

Another object of the present invention is to provide a liquid-jetting apparatus capable of preventing the wet deviation of a liquid particle jetted immediately after a flushing operation, of optimizing a flushing operation in respect of effect and necessary time, and a driving method of driving the liquid-jetting apparatus.

Still another object of the present invention is to provide a liquid-jetting apparatus capable of achieving a flushing operation without trouble after a cleaning operation, and a driving method of driving the liquid-jetting apparatus.

According to the present invention, a liquid-jetting apparatus comprises: a liquid-jetting head provided with nozzle openings and capable of jetting liquid particles through the nozzle openings; and a recovering unit to recover from a thickened state in a liquid in the nozzle openings, the recovering unit including a flushing unit that carries out a flushing operation to jet the liquid in the nozzle openings in minute liquid particles, the minute liquid particle having a weight of 10 ng or below and being jetted at a jetting speed of 8 m/s or above.

According to the present invention, a liquid-jetting apparatus comprises: a liquid-jetting head provided with nozzle openings and capable of jetting liquid particles through the nozzle openings; and a recovering unit to recover from a thickened state in a liquid in the nozzle openings, the recovering unit including a flushing unit that carries out a flushing operation to jet the liquid in the nozzle openings in minute liquid particles, wherein a meniscus of the liquid formed in the nozzle opening is retracted greatly immediately before the minute liquid particle is jetted by the flushing unit, and the minute liquid particle is jetted through a central part of the meniscus.

Preferably, the liquid-jetting head has pressure chambers respectively communicating with the nozzle openings and containing the liquid, and pressure generating means to vary pressure in the pressure chambers to jet liquid particles through the nozzle openings, and the flushing unit has a driving unit to drive the pressure generating means for the flushing operation.

Preferably, the pressure generating means includes piezoelectric members capable of deforming the pressure chambers to jet liquid particles through the nozzle openings, and the driving unit gives a driving signal to the piezoelectric member.

Preferably, the driving signal given by the driving unit to the piezoelectric member includes: a first voltage-raising part to apply a voltage for expanding the pressure chamber so that the pressure in the pressure chamber is reduced to the piezoelectric member, a first voltage holding part to apply a voltage for maintaining the pressure chamber at a reduced pressure to the piezoelectric member, a first voltage-reducing part to apply a voltage for contracting the pressure chamber to raise the pressure in the pressure chamber to a slightly reduced pressure to the piezoelectric member, a second voltage holding part to apply a voltage for maintaining the pressure chamber at the slightly reduced pressure to the piezoelectric member, and a second voltage-reducing part to apply a voltage for setting the pressure chamber in its original state to the piezoelectric member.

Preferably, the first voltage-raising part of the driving signal has an auxiliary voltage-maintaining part to apply a voltage to the piezoelectric member such that the pressure in the pressure chamber is maintained temporarily at a slightly or moderately reduced pressure during an expansion of the pressure chamber to reduce the pressure in the pressure chamber.

Preferably, the flushing unit is capable of carrying out the flushing operation selectively in a first flushing mode or a second flushing mode. The flushing operation of the first mode jets a minute liquid particle having a weight of 10 ng or below at a jetting speed of 8 m/s or above. The flushing operation of the second mode jets a minute liquid particle having a weight of 12 ng or above.

The liquid-jetting apparatus further comprises:

a head moving mechanism to move the liquid-jetting head in a scanning direction; a capping mechanism disposed in a head-moving range in which the liquid-jetting head is able to move and capable of covering the nozzle openings;

a timer for measuring a time elapsed after the nozzle openings have been covered with the capping mechanism; and a mode control unit to selectively determine the mode of the flushing operation based on the time measured by the timer.

Preferably, the flushing unit carries out the flushing operation in the first flushing mode only when the time measured by the timer is in a range of a predetermined first time and a predetermined second time, and carries out the flushing operation in the second flushing mode when the time measured by the timer is outside the range of the first time and the second time.

Preferably, the first time is two minutes, and the second time is five minutes.

Preferably, the flushing unit operates in the first flushing mode in an initial stage of the flushing operation, and starts operating in the second flushing mode a predetermined time after a start of the flushing operation.

Preferably, the liquid-jetting head has pressure chambers respectively communicating with the nozzle openings and containing the liquid, and pressure generating means to vary pressure in the pressure chambers to jet the liquid particles through the nozzle openings. The flushing unit has a driving unit to drive the pressure generating means. The pressure generating means includes piezoelectric members capable of deforming the pressure chambers to jet the liquid particles through the nozzle openings. The driving unit gives a first driving signal to the piezoelectric member for the flushing operation in the first flushing mode, and gives a second driving signal to the piezoelectric member for the flushing operation in the second flushing mode. The first driving signal and the second driving signal are made by selectively using parts of a common driving signal.

Preferably, the first driving signal has: a first voltage-raising part to apply a voltage to the piezoelectric member such that the pressure chamber is expanded and the pressure in the pressure chamber is reduced to a reduced pressure, a first voltage holding part to apply a voltage to the piezoelectric member such that the pressure chamber is maintained at the reduced pressure, a first voltage-reducing part to apply a voltage to the piezoelectric member such that the pressure chamber is contracted and the pressure in the pressure chamber is raised to a slightly reduced pressure, a second voltage holding part to apply a voltage to the piezoelectric member such that the pressure chamber is maintained at the slightly reduced pressure, and a second voltage-reducing part to apply a voltage to the piezoelectric member such that the pressure chamber is restored to its original state; and the second driving signal has: a first voltage-raising part to apply a voltage to the piezoelectric vibrator such that the pressure chamber is expanded and the pressure in the pressure chamber is reduced to a low pressure, a first voltage holding part to apply a voltage to the piezoelectric vibrator such that the pressure chamber is maintained at the low pressure, a first voltage-reducing part to apply a voltage to the piezoelectric vibrator such that the pressure chamber is contracted and the pressure in the pressure chamber is raised to a high pressure, a second voltage-holding part to apply a voltage to the piezoelectric vibrator such that the pressure chamber is maintained at the high pressure, and a second voltage-raising part to apply a voltage to the piezoelectric vibrator such that the pressure chamber is restored to its original state.

According to the present invention, a liquid-jetting apparatus comprises: a liquid-jetting head provided with nozzle openings and capable of jetting liquid particles through the nozzle openings; and a recovering unit to recover from a thickened state in a liquid in the nozzle openings, the recovering unit including a flushing unit that carries out a flushing operation to jet the liquid in the nozzle openings in minute liquid particles, wherein the liquid-jetting head is provided with pressure chambers respectively communicating with the nozzle openings and capable of containing the liquid, and pressure generating means driven by liquid-jetting signals to vary pressure in the pressure chambers such that the liquid particles are jetted through the nozzle openings, wherein the flushing unit drives the pressure generating means by a driving signal for flushing, and wherein the driving signal for flushing is generated independently of the liquid-jetting signal.

Preferably, the pressure generating means includes piezoelectric members capable of deforming the pressure chambers to jet liquid particles through the nozzle openings.

Preferably, the minute liquid particle has a weight of 10 ng or below and is jetted at a jetting speed of 8 m/s or above.

Preferably, a meniscus of the liquid formed in the nozzle opening is retracted greatly immediately before the minute liquid particle is jetted by the flushing unit, and the minute liquid particle is jetted through a central part of the meniscus.

According to the present invention, a liquid-jetting apparatus comprises: a liquid-jetting head provided with nozzle openings and pressure chambers respectively communicating with the nozzle openings, and capable of varying pressure applied to a liquid contained in the pressure chambers to jet liquid particles through the nozzle openings and of selectively jetting a plurality of kinds of liquid particles respectively having different volumes through each of the nozzle openings; and a flushing control unit capable of controlling a flushing operation such that the liquid-jetting head jets liquid particles through the nozzle openings to recover from a thickened state in a liquid in the nozzle openings; wherein the flushing control unit makes the nozzle opening jet at least two kinds of liquid particles among the plurality of kinds of liquid particles respectively having different volumes in one cycle of the flushing operation.

Preferably, the two kinds of liquid particles to be jetted in one cycle of the flushing operation include a liquid particle having a smallest volume among those of the plurality of kinds of liquid particles respectively having different volumes.

Preferably, the liquid particle having the smallest volume is jetted first in one cycle of the flushing operation.

Preferably, the liquid particle having the smallest volume is jetted last in one cycle of the flushing operation.

Preferably, the liquid particle having the smallest volume is jetted at least twice in one cycle of the flushing operation, and the liquid particles having the smallest volume are jetted first and last, respectively, in one cycle of the flushing operation.

Preferably, the two kinds of liquid particles to be jetted in one cycle of the flushing operation include a liquid particle having a largest volume among those of the plurality of kinds of liquid particles.

According to the present invention, a method of driving a liquid-jetting apparatus having a liquid-jetting head provided with nozzle openings and pressure chambers respectively communicating with the nozzle openings, and capable of varying pressure applied to a liquid contained in the pressure chambers to jet liquid particles through the nozzle openings and of selectively jetting a plurality of kinds of liquid particles respectively having different volumes through each of the nozzle openings, and a flushing control unit capable of controlling a flushing operation such that the liquid-jetting head jets liquid particles through the nozzle openings to recover from a thickened state in a liquid in the nozzle openings; wherein the flushing operation is executed by the flushing control unit so that at least two kinds of liquid particles among the plurality of kinds of liquid particles respectively having different volumes are jetted in one cycle of the flushing operation.

Preferably, the two kinds of liquid particles to be jetted in one cycle of the flushing operation include a liquid particle having a smallest volume among those of the plurality of kinds of liquid particles respectively having different volumes.

Preferably, the liquid particle having the smallest volume is jetted first in one cycle of the flushing operation.

Preferably, the liquid particle having the smallest volume is jetted last in one cycle of the flushing operation.

Preferably, the liquid particle having the smallest volume is jetted at least twice in one cycle of the flushing operation, and the liquid particles having the smallest volume are jetted first and last, respectively, in one cycle of the flushing operation.

Preferably, the two kinds of liquid particles to be jetted in one cycle of the flushing operation include a liquid particle having a largest volume among those of the plurality of kinds of liquid particles.

According to the present invention, a liquid-jetting apparatus comprises: a liquid-jetting head provided with nozzle openings and pressure chambers respectively communicating with the nozzle openings, and capable of varying pressure applied to a liquid contained in the pressure chambers to jet liquid particles through the nozzle openings and of selectively jetting a plurality of kinds of liquid particles respectively having different volumes through each of the nozzle openings; and a flushing control unit capable of controlling a flushing operation such that the liquid-jetting head jets liquid particles through the nozzle openings to recover from a thickened state in a liquid in the nozzle openings; wherein the flushing control unit is capable of selecting an optimum flushing mode among a plurality of flushing modes according to a degree of thickening of the liquid in the nozzle opening, and liquid particles among the plurality of kinds of liquid particles respectively having different volumes excluding a liquid particle having a largest volume are jetted for the flushing operation in any one of the plurality of flushing modes.

Preferably, a volume of the liquid particle to be jetted for the flushing operation is about half a volume of the liquid particle having the largest volume among those of the plurality of kinds of liquid particles respectively having different volumes.

Preferably, the liquid particle to be jetted for the flushing operation has a smallest volume among those of the plurality of kinds of liquid particles respectively having different volumes.

Preferably, the liquid particles are jetted for the flushing operation by a jetting operation other than a jetting operation including steps of continuously expanding the pressure chamber to increase a volume of the pressure chamber, holding the pressure chamber in an expanded state, continuously contracting the pressure chamber to reduce the volume of the pressure chamber, holding the pressure chamber in a contracted state, and continuously expanding the pressure chamber.

Preferably, the jetting operation of jetting the liquid particle for the flushing operation includes steps of continuously expanding the pressure chamber to increase the volume of the pressure chamber, holding the pressure chamber in an expanded state, continuously and moderately contracting the pressure chamber to reduce the volume of the pressure chamber to a middle reduced level, holding the pressure chamber in a moderately contracted state, and continuously and sufficiently contracting the pressure chamber to a greatest reduced level.

Preferably, the jetting operation of jetting the liquid particle for the flushing operation includes steps of continuously expanding the pressure chamber to increase the volume of the pressure chamber, holding the pressure chamber in an expanded state, continuously and moderately contracting the pressure chamber to a moderately contracted state, holding the pressure chamber in the moderately contracted state, continuously expanding the pressure chamber again to an expanded state, holding the pressure chamber in the expanded state, contracting the pressure chamber again to a contracted state, holding the pressure chamber in the contracted state, and continuously expanding the pressure chamber again.

According to the present invention, a method of driving a liquid-jetting apparatus having a liquid-jetting head provided with nozzle openings and pressure chambers respectively communicating with the nozzle openings, and capable of varying pressure applied to a liquid contained in the pressure chambers to jet liquid particles through the nozzle openings and of selectively jetting a plurality of kinds of liquid particles respectively having different volumes through each of the nozzle openings, and a flushing control unit capable of controlling a flushing operation such that the liquid-jetting head jets liquid particles through the nozzle openings to recover from a thickened state in a liquid in the nozzle openings, comprises: selecting an optimum flushing mode among a plurality of flushing modes by the flushing control unit according to a degree of thickening of the liquid in the nozzle openings; and executing the flushing operation so that the liquid particles particles are jetted through the nozzle openings using a selected flushing mode;

wherein the liquid particles among the plurality of kinds of liquid particles respectively having different volumes excluding a liquid particle having a largest volume are jetted for the flushing operation in any one of the plurality of flushing modes.

Preferably, a volume of the liquid particle to be jetted for the flushing operation is about half a volume of the liquid particle having the largest volume among those of the plurality of kinds of liquid particles respectively having different volumes.

Preferably, the liquid particle to be jetted for the flushing operation is a liquid particle having a smallest volume among those of the plurality of kinds of liquid particles respectively having different volumes.

Preferably, the liquid particles are jetted for the flushing operation by a jetting operation other than a jetting operation including steps of continuously expanding the pressure chamber to increase a volume of the pressure chamber, holding the pressure chamber in an expanded state, continuously contracting the pressure chamber to reduce the volume of the pressure chamber, holding the pressure chamber in a contracted state, and continuously expanding the pressure chamber.

Preferably, the jetting operation of jetting the liquid particle for the flushing operation includes steps of continuously expanding the pressure chamber to increase the volume of the pressure chamber, holding the pressure chamber in an expanded state, continuously and moderately contracting the pressure chamber to reduce the volume of the pressure chamber to a middle reduced level, holding the pressure chamber in a moderately contracted state, and continuously and sufficiently contracting the pressure chamber to a greatest reduced level.

Preferably, the jetting operation of jetting the liquid particle for the flushing operation includes steps of continuously expanding the pressure chamber to increase the volume of the pressure chamber, holding the pressure chamber in an expanded state, continuously and moderately contracting the pressure chamber to a moderately contracted state, holding the pressure chamber in the moderately contracted state, continuously expanding the pressure chamber again to an expanded state, holding the pressure chamber in the expanded state, contracting the pressure chamber again to a contracted state, holding the pressure chamber in the contracted state, and continuously expanding the pressure chamber again.

According to the present invention, a liquid-jetting apparatus comprises: a liquid-jetting head provided with nozzle openings and pressure chambers respectively communicating with the nozzle openings, and capable of varying pressure applied to a liquid contained in the pressure chambers by pressure generating means to jet liquid particles through the nozzle openings, and of selectively jetting a plurality of kinds of liquid particles respectively having different volumes through each of the nozzle openings;

a driving signal generating unit capable of selectively generating driving signals respectively having different frequencies for driving the pressure generating means;

a cleaning control unit capable of carrying out a cleaning operation that draws out the liquid through the nozzle openings by suction; and a flushing control unit capable of carrying out a flushing operation that operates the pressure generating means such that the liquid-jetting head jets liquid particles through the nozzle openings into a non-recording region; wherein, after a cleaning operation has been carried out by the cleaning control unit, the flushing control unit carries out a flushing operation by making the driving signal generating unit generate a driving signal of a frequency other than a highest frequency among those of the driving signals that can be generated by the driving signal generating unit to jet liquid particles having a smallest volume among those of the plurality of kinds of liquid particles respectively having different volumes.

Preferably, the driving signal for driving the pressure generating means for the flushing operation has a lowest frequency among those of the driving signals that can be generated by the driving signal generating unit.

Preferably, the driving signal for driving the pressure generating means for the flushing operation is used also for driving the pressure generating means in a high-quality recording mode.

Preferably, the driving signal for driving the pressure generating means for the flushing operation is used exclusively for the flushing operation.

Preferably, a frequency of the driving signal for driving the pressure generating means for the flushing operation is in a range of 0.1 to 3 kHz.

Preferably, the liquid particle used for the flushing operation has a weight in a range of 1 to 20 ng.

Preferably, each of the nozzle openings jets liquid particles 1000 times or above for the flushing operation.

The liquid-jetting apparatus further comprises a minute-vibration control unit that applies a minute-vibration pulse by using a driving signal generated by the driving signal generating unit to the pressure generating means to vibrate a meniscus of the liquid in the nozzle opening for slight vibrations after completing the flushing operation.

The liquid-jetting apparatus further comprises a stationary-state control unit capable of holding the pressure generating means in a stationary state for a predetermined time after completing the flushing operation.

Preferably, the predetermined time is one second or longer.

Preferably, after the minute-vibration control unit has completed a minute-vibration operation, the flushing control unit makes the driving signal generating unit generate a driving signal of a frequency higher than that of the driving signal used for jetting the liquid particle having the smallest volume for flushing to jet a liquid particle having a volume larger than that of the liquid particle having the smallest volume through the nozzle opening into the non-recording region for a second flushing operation.

Preferably, the second flushing operation uses a driving signal of the highest frequency among those of driving signals that can be generated by the driving signal generating unit to jet a liquid particle having a largest volume among those of the plurality of kinds of liquid particles respectively having different volumes through the nozzle opening.

According to the present invention, a method of driving a liquid-jetting apparatus having a liquid-jetting head provided with nozzle openings, pressure chambers respectively communicating with the nozzle openings and pressure generating means capable of varying pressure applied to a liquid contained in the pressure chambers to jet liquid particles through the nozzle openings, and capable of selectively jetting a plurality of kinds of liquid particles respectively having different volumes through each of the nozzle openings, a driving signal generating unit to generate a driving signal for driving the pressure generating means, capable of selectively generating driving signals respectively having different frequencies, comprises: a cleaning step of cleaning the nozzle openings by drawing out the liquid through the nozzle openings by suction; and a flushing step of, after completing the cleaning step, jetting liquid particles having a smallest volume among those of the plurality of kinds of liquid particles respectively having different volumes through the nozzle openings into a non-recording region for a flushing operation by making the driving signal generating unit generate a driving signal of a frequency other than a highest frequency among those of the driving signals that can be generated by the driving signal generating unit.

Preferably, the driving signal to be used for the flushing operation has a lowest frequency among those of the driving signals that can be generated by the driving signal generating unit.

Preferably, the driving signal to be used for the flushing operation is used also for driving the pressure generating means in a high-quality recording mode.

Preferably, the driving signal for driving the pressure generating means for the flushing operation is used exclusively for the flushing operation.

Preferably, the frequency of the driving signal for driving the pressure generating means for the flushing operation is in a range of 0.1 to 3 kHz.

Preferably, the liquid particle used for the flushing operation have a weight in a range of 1 to 20 ng.

Preferably, each of the nozzle openings jets liquid particles 1000 times or above for the flushing operation.

The method of driving a liquid-jetting apparatus further comprises a minute-vibration step of applying a minute-vibration pulse by using a driving signal generated by the driving signal generating unit to the pressure generating means to vibrate a meniscus of the liquid in the nozzle opening for slight vibrations after completing the flushing operation.

The method of driving a liquid-jetting apparatus further comprises a stationary-state control step of holding the pressure generating means in a stationary state for a predetermined time after completing the flushing operation.

Preferably, the predetermined time is one second or longer.

The method of driving a liquid-jetting apparatus further comprises a second flushing step of, after the minute-vibration step has been completed, making the driving signal generating unit generate a driving signal of a frequency higher than that of the driving signal used for jetting the liquid particle having the smallest volume for flushing to jet a liquid particle having a volume larger than that of the liquid particle having the smallest volume through the nozzle opening into the non-recording region.

Preferably, the second flushing step uses a driving signal of the highest frequency among those of driving signals that can be generated by the driving signal generating unit to jet a liquid particle having a largest volume among those of the plurality of kinds of liquid particles respectively having different volumes through the nozzle opening.

BRIEF DESCRIPTION OF THE DRAWINGS

The above and other objects features and advantages of the present invention will become more apparent from the following description taken in connection with the accompanying drawings, in which.

DESCRIPTION OF THE PREFERRED EMBODIMENTS

Figure 1:
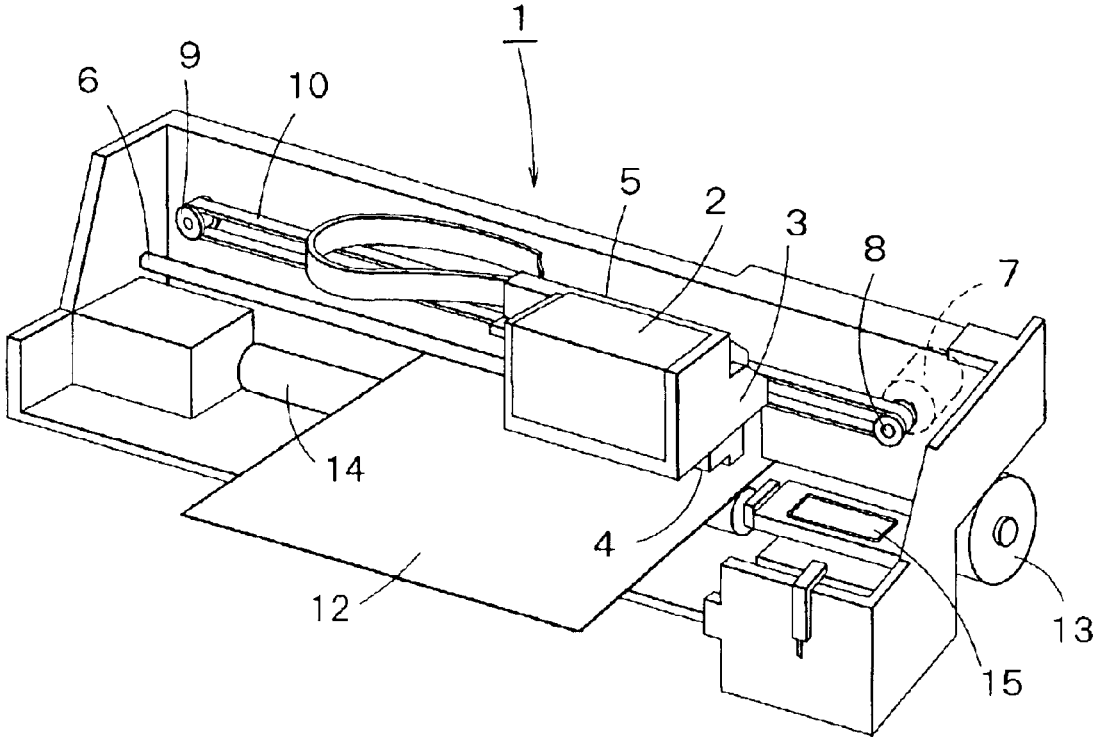
FIG. 1 is a schematic perspective view of an ink-jet recording apparatus in a preferred embodiment according to the present invention.

Referring to FIG. 1, an ink-jet recording apparatus in a first embodiment according to the present invention is an ink-jet printer 1 including a carriage 5 carrying a cartridge holder 3 capable of holding an ink cartridge 2, and a recording head 4 (liquid-jetting head). The carriage 5 is reciprocated along a scanning path by a carriage-moving mechanism.

Figure 5:
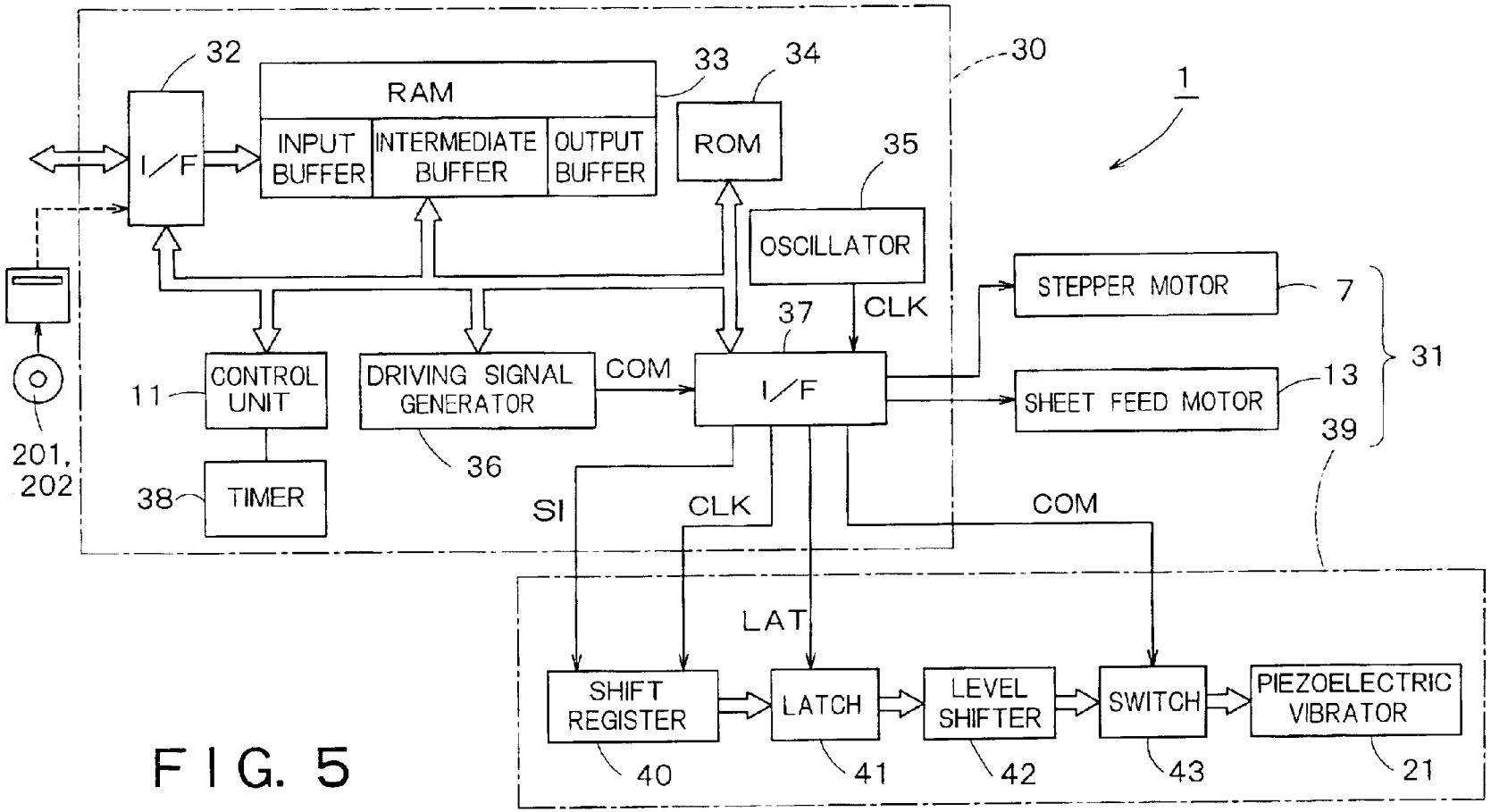
FIG. 5 is block diagram of assistance in explaining the construction of the ink-jet recording apparatus shown in FIG. 1.

The carriage-moving mechanism includes a guide member 6 transversely extended in a housing, a stepper motor 7 disposed at one end of the housing, a drive pulley 8 fixedly mounted on the output shaft of the stepper motor 7, an idle pulley 9 supported at the other end of the housing, a timing belt 10 extended between the drive pulley 8 and the idle pulley 9 and fastened to the carriage 5, and a control unit 11 shown in FIG. 5 that controls the stepper motor 7. The stepper motor 7 drives the carriage 5 carrying the recording head 4 for reciprocation along the scanning path parallel to the width of a recording sheet 12.

The ink-jet printer 1 is provided with a sheet feed mechanism for feeding a recording sheet 12, i.e., a recording medium, in a feed direction. The sheet feed mechanism includes a sheet feed motor 13 and a platen roller 14. The recording sheet 12 is fed gradually as a recording operation proceeds.

The carriage-moving mechanism and the sheet feed mechanism are designed such that the ink-jet printer is able to print on the large recording sheet 12 of a size substantially equal to the size B0 (JIS, 1030 mm×1456 mm). The ink-jet printer 1 in this embodiment is a one-way printer that performs a recording operation while the recording head 4 is moved for a forward stroke.

Figure 2A:
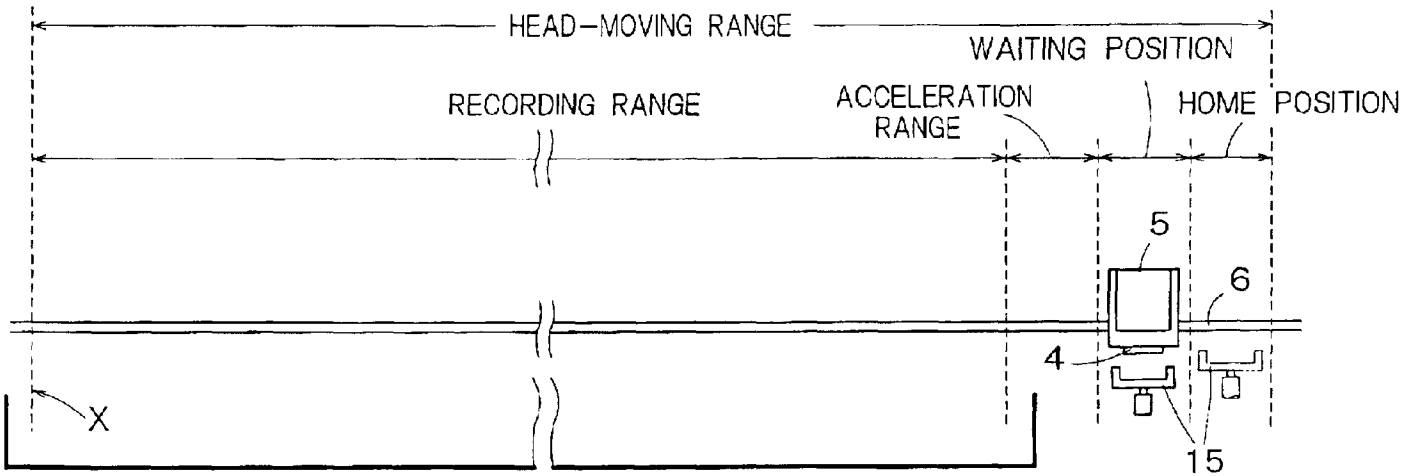
FIG. 2A is a typical view of assistance in explaining a scanning range for the recording head of a one-way printer.

The carriage 5 is movable in a head-moving range including a recording range and an end range outside the recording range. A home position, and a waiting position where the recording head 4 (the carriage 5) is held are set in the end range. As shown in FIG. 2A, the home position lies at a far end on one side, i.e., the right side as viewed in FIG. 2A, of the head-moving range in which the recording head 4 can be moved. The waiting position lies on the side of the recording range with respect to the home position.

The present invention is applicable to a two-way printer in which a recording head 4 performs a recording operation both during a forward stroke and during a backward stroke. If the ink-jet printer 1 is such a two-way printer, a home position and a first waiting position WP1 are set in one end section of a head-moving range, and a second waiting position WP2 is set in the other end section of the head-moving range as shown in FIG. 2B.

Figure 3:
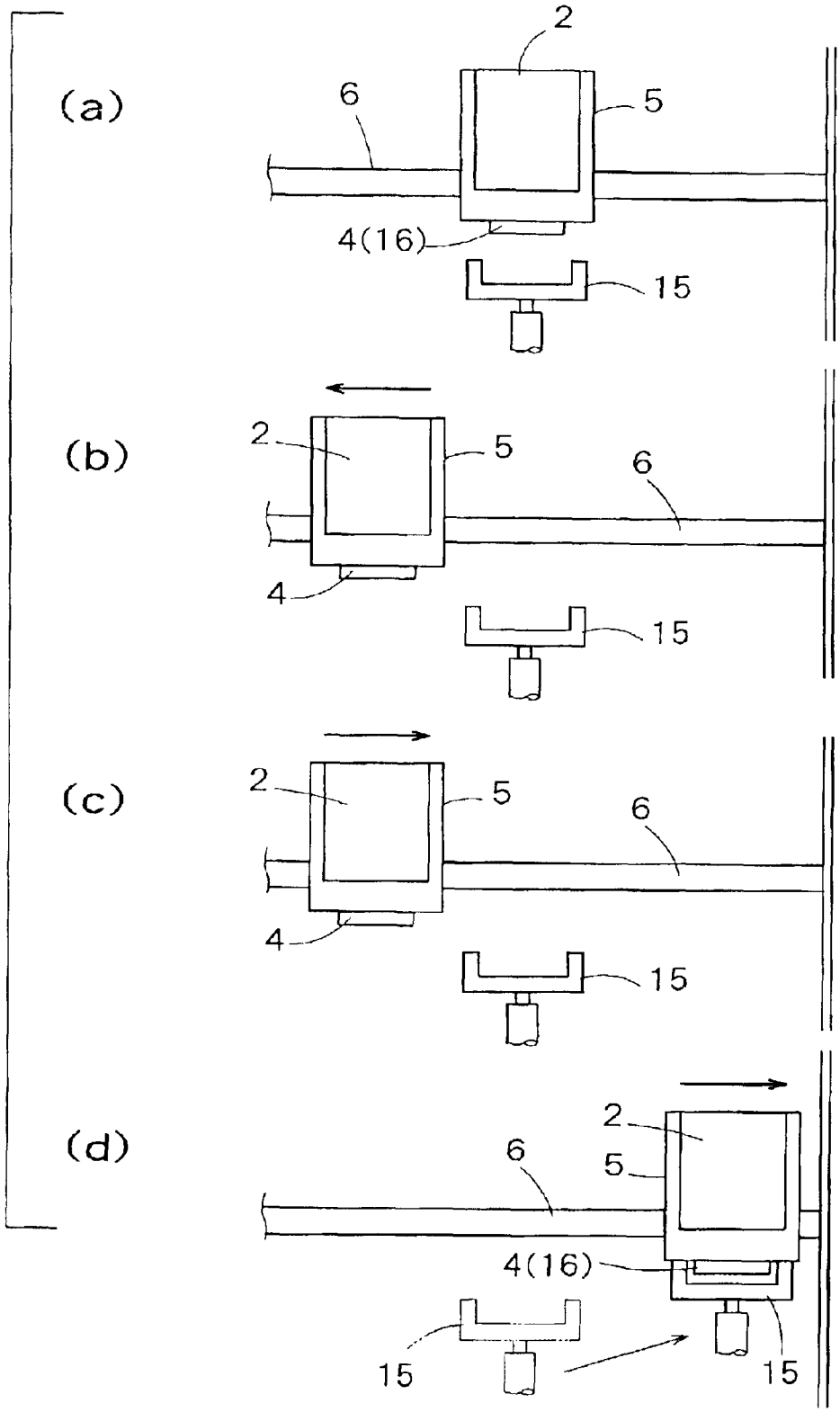
FIG. 3 is a typical view of assistance in explaining the operation of a recording head, in which (a) indicates the recording head at a waiting position, (b) indicates the recording head moving from the waiting position into a recording region, (c) indicates the recording head returning from the recording region to the waiting position, and (d) indicates the recording head at a home position.

The recording head 4 is held at the home position while the ink-jet printer 1 is disconnected from a power supply or the recording operation of the ink-jet printer 1 is suspended for a long time. When the recording head 4 is held at the home position, a cap 15 included in a capping mechanism is brought into contact with the recording head 4 so as to cover a nozzle plate 16 (FIG. 4) provided with nozzle openings 17 (FIG. 4) as shown in FIG. 3(*d*). The cap 15 is formed of an elastic material, such as rubber, in the shape of a substantially rectangular tray. The cap 15 is lined with a moisture retention member. When the cap 15 is put on the recording head 4, a space defined by the cap 15 and the nozzle plate 16 is kept in a highly humid state to suppress the evaporation of the ink solvent through the nozzle openings 17.

The recording head 4 starts from the waiting position for the recording operation. Normally, the recording head 4 is held at the waiting position. The recording head 4 is moved into the recording range to perform the recording operation and is returned to the waiting position after the completion of the recording operation.

Figure 2B:
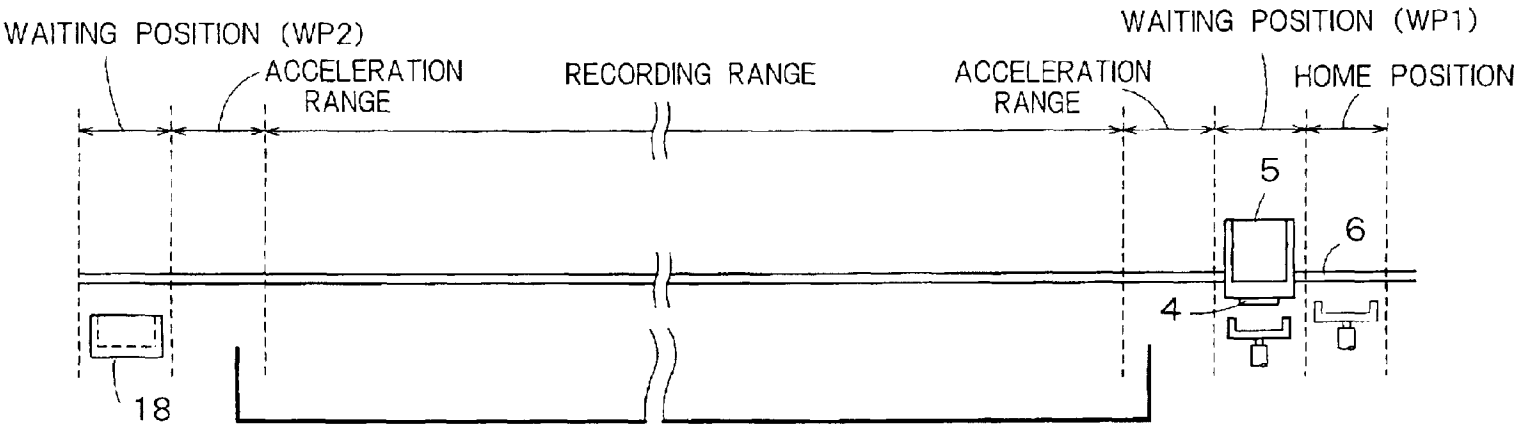
FIG. 2B is a typical view of assistance in explaining a scanning range for the recording head of a two-way printer.

Referring to FIG. 2B, if the ink-jet printer 1 is a two-way printer, the recording head 4 is held at the first waiting position WP1 before starting the recording operation. The recording head 4 is moved from the first waiting position WP1 toward the second waiting position WP2 for a forward recording cycle, and is held at the second waiting position WP2 after the completion of the forward recording cycle. Then, the recording head 4 is moved from the second waiting position WP2 toward the first waiting position WP1 for a backward recording cycle. The recording head 4 is held at the first waiting position WP1 after the completion of the backward recording cycle. Thus, the recording head 4 is moved to repeat the forward and the backward recording cycle alternately.

An ink sump is disposed at the waiting position to collect the ink jetted by the recording head 4 for a flushing operation, i.e., a sort of maintenance work. In this embodiment, the cap 15 serves also as the ink sump. Normally, the cap 15 is disposed at a position below the waiting position as shown in FIG. 3(*a*) so as to be spaced from the nozzle plate 16 of the recording head 4 as held at the waiting position. The cap 15 is moved obliquely upward, i.e., upward and toward the nozzle plate 16, as the recording head 4 is moved toward the home position to seal the nozzle openings 17 when the recording head 4 is located at the home position.

If the ink-jet printer 1 is a two-way printer, an ink sump 18 is disposed below the second waiting position WP2 as shown in FIG. 2B. The ink sump 18 is, for example, a flushing box having the shape of a box having an open side facing the recording head 4 as located at the second waiting position WP2.

In this embodiment, an acceleration range extends between the waiting position and the recording range. The recording head 4 is accelerated to the scanning speed while the same is moving in the acceleration range.

Figure 4:
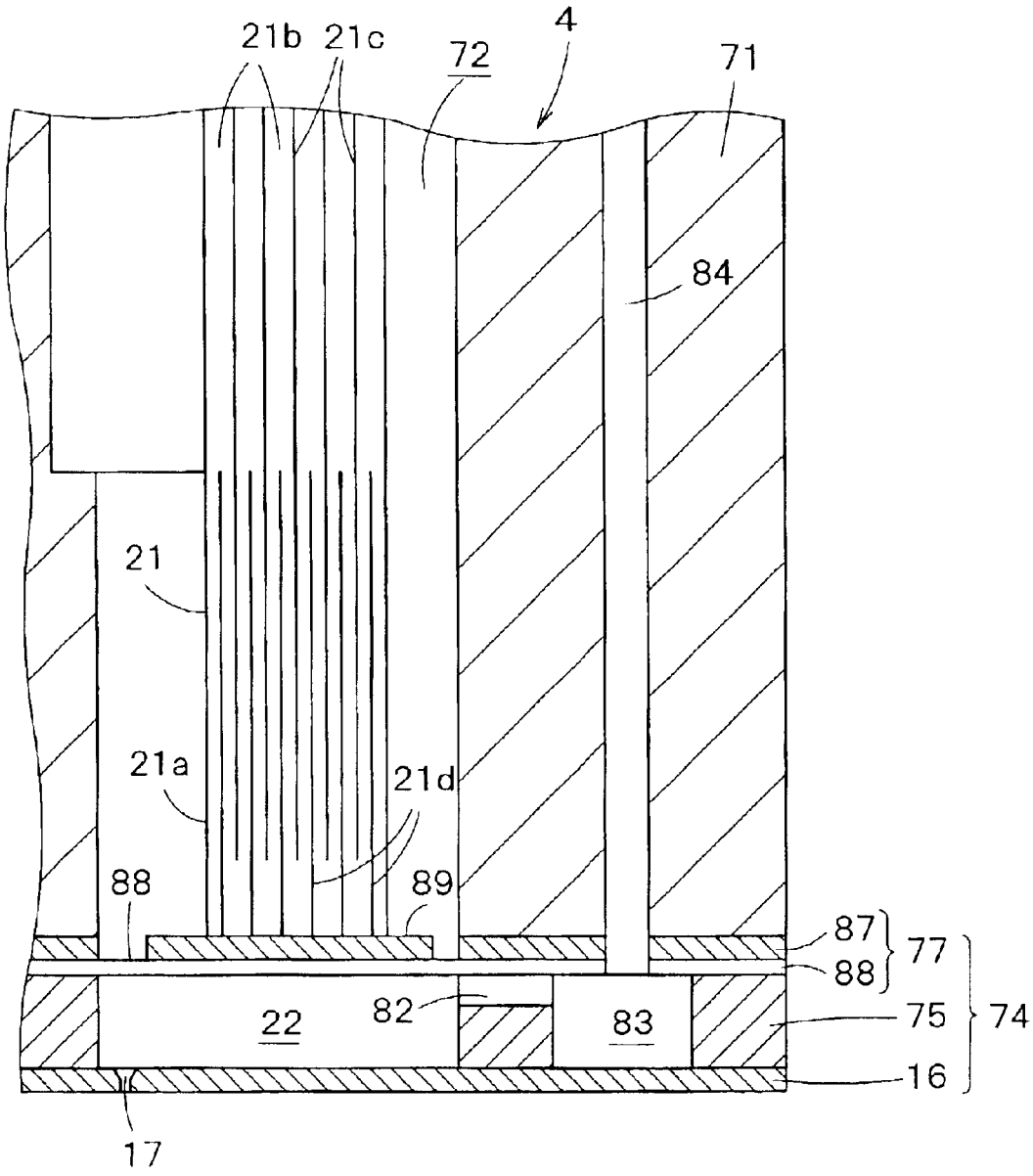
FIG. 4 is a schematic sectional view of the recording head.

The recording head 4 will be described. Referring to FIG. 4, the recording head 4 has a case 71 formed of a plastic material in the shape of a box. Piezoelectric vibrators 21 formed in the shape of a comb are inserted through an open upper end, as viewed in FIG. 4, of the case 71 in the case 71 so that lower end parts 21*a* thereof face an open lower end, as viewed in FIG. 4, of the case 71. An ink passage unit 74 is joined to the lower surface, as viewed in FIG. 4, of the case 71, and the lower end parts 21*a* are joined to predetermined parts of the ink passage unit 74, respectively.

The piezoelectric vibrators 21 are formed by slotting a vibrating plate formed by alternately superposing common internal electrodes 21*c* and individual internal electrodes 21*d* with piezoelectric elements 21*b* held between the electrodes 21*c* and 21*d* in the shape of a comb arranged in a density corresponding to a dot density. Each piezoelectric vibrator 21 extends and contracts longitudinally in a direction perpendicular to a direction in which the components thereof are superposed when a voltage is applied across the common internal electrode 21*c* and the individual internal electrode 21*d*.

The ink passage unit 74 includes the nozzle plate 16, an elastic plate 77, and an ink passage plate 75 sandwiched between the nozzle plate 16 and the elastic plate 77.

The ink passage plate 75 defines a plurality of pressure chambers 22 arranged in a row, separated by partition walls and respectively communicating with the plurality of nozzle openings 17 formed in the nozzle plate 16, a plurality of ink supply passages 82 connected to at least one end of each pressure chamber 22, and an elongate common ink chamber 83 from which all the ink supply passages 82 extend. For example, a silicon wafer is processed by an etching process such that the elongate common ink chamber 83 is formed in the silicon wafer, the pressure chambers 22 are formed so as to be arranged along the common ink chamber 83 at pitches corresponding to those of the nozzle openings 17, and the ink supply passages 82 having the shape of a groove are extended between the common ink chamber 83 and the pressure chambers 22. The ink supply passage 82 is connected to one end of each pressure chamber 22, and the other end of each pressure chamber 22 corresponds to the nozzle opening 17. The ink supplied from an ink cartridge to the common ink chamber 83 is distributed to the pressure chambers. An ink supply pipe 84 is connected to a substantially middle part of the common ink chamber 83.

The elastic plate 77 is attached to the upper surface of the ink passage plate 75 opposite to the lower surface to which the nozzle plate 16 is attached. The elastic plate 77 is formed by laminating an elastic film 88 of a polymer, such as PPS to the lower surface of a stainless steel plate 87. Islands 89 are formed in parts, corresponding to the pressure chambers 22, of the stainless steel plate 87 by an etching process. The piezoelectric vibrators 21 are connected to the islands 89, respectively.

In the recording head 4 thus constructed, the piezoelectric vibrator 21 is extended longitudinally to press the corresponding island 89 toward the nozzle plate 16. Consequently, a part, around the island 89, of the elastic film 88 is deformed so as to reduce the volume of the pressure chamber 22. When the extended piezoelectric vibrator 21 is longitudinally contracted, the volume of the pressure chamber 22 is increased by the resilience of the elastic film 88. Ink pressure in the pressure chamber 22 increases and an ink particle is jetted through the nozzle opening 17 when the pressure chamber 22 is contracted after the same has been expanded.

In the recording head 4, the volume of the pressure chamber 22 varies when the piezoelectric vibrator 21 is energized and de-energized. An ink particle can be jetted through the nozzle opening 17. Moreover, the meniscus of the ink, i.e., the free surface of the ink in the nozzle opening 17, can be vibrated slightly by using the variation of the ink pressure in the pressure chamber 22.

A piezoelectric vibrator that vibrates in a transverse vibration mode may be used instead of the piezoelectric vibrator 21 that vibrates in a longitudinal vibration mode. A piezoelectric vibrator that vibrates in a transverse vibration mode reduces the volume of the pressure chamber when the same is energized and increases the volume of the pressure chamber when the same is de-energized.

Preferably, the recording head 4 is a multicolor recording head capable of printing dots of a plurality of colors. A multicolor recording head consists of a plurality of head units that use different kinds of inks, respectively.

For example, a recording head may consist of four head units, namely, a black head unit capable of jetting a black in, a cyan head unit capable of jetting a cyan ink, a magenta head unit capable of jetting a magenta ink and an yellow head unit capable of jetting an yellow ink.

The electrical configuration of the ink-jet printer 1 will be described. As shown in FIG. 5, the ink-jet printer 1 has a printer controller 30 and a print engine 31.

The printer controller 30 includes an external interface (external I/F) 32, a RAM 33 for temporarily storing data, a ROM 34 storing control programs and such, the control unit 11 including a CPU, an oscillator 35 that generates a clock signal, a driving signal generator 36 that generates driving signals including a driving signal for driving the recording head 4, an internal interface (internal I/F) 37 that sends dot pattern data (bit map data) developed on the basis of printing data to the print engine 31, and a timer 38.

The external I/F 32 receives printing data including, for example, character codes, graphic functions, image data and such from a host computer, not shown, or the like. A busy signal (BUSY) and an acknowledge signal (ACK) are sent through the external I/F 32 to the host computer.

The RAM 33 includes an input buffer, an intermediate buffer, an output buffer and a work memory, not shown. The input buffer stores printing data received through the external I/F 32 temporarily. The intermediate buffer stores intermediate code data provided by the control unit 11. The output buffer stores dot pattern data. The dot pattern data is printing data produced by decoding (translating) intermediate data, such as gradation data.

The ROM 34 stores control programs (control routines) specifying operations for processing data, font data, and graphic functions. The ROM 34 serves as a maintenance information storage means for storing set data specifying maintenance operations.

The control unit 11 executes control operations according to the control programs stored in the ROM 34. For example, the control unit 11 reads the printing data from the input buffer, converts the printing data into corresponding intermediate code data, and stores the intermediate code data in the intermediate buffer. The control unit 11 reads the intermediate code data from the intermediate buffer, analyzes the intermediate code data, and provides a dot pattern data by developing (decoding) the intermediate code data, making reference to the font data and the graphic functions stored in the ROM 34. The control unit 11 stores the dot pattern data in the output buffer after processing the dot pattern data by a necessary decoration process.

After the dot pattern data on a dot pattern that can be recorded in one recording line by the operation of the recording head 4 for one scanning cycle has been provided, the dot pattern data for the line is given sequentially from the output buffer through the internal I/F 37 to electric driving systems 39 included in the recording head 4, the carriage 5 is driven to print the dot pattern data for the line. When the dot pattern data for the line is provided by the output buffer, the previously developed intermediate code data is erased and eliminated from the intermediate buffer, and the next intermediate code data is developed.

The control unit 11 constitutes a recovering unit including a flushing unit with a driving unit for a flushing operation (one of the recovery operations) and controls a maintenance operation (one of the recovery operations) prior to the start of the recording operation of the recording head 4.

In this embodiment, the timer 38 measures a time, i.e., capping time, for which the nozzle openings 17 of the recording head 4 is sealed by the cap 15.

The print engine 31 has a sheet feed mechanism including the sheet feed motor 13, a head-moving mechanism including the stepper motor 7, and the electric driving systems 39 included in the recording head 4.

The electric driving systems 39 of the recording head 4 will be explained hereinafter. The electric driving systems 39 are associated with the nozzle openings 17 of the recording head 4, respectively. Referring to FIG. 5, each electric driving system 39 comprises a shift register 40, a latch circuit 41, a level shifter 42, a switching circuit 43 and the piezoelectric vibrators 21, which are electrically connected in that order.

When printing data "1" is given to the switching circuit 43, the switching circuit 43 goes on, a driving signal is given directly to the piezoelectric vibrator 21, and the piezoelectric vibrator 21 deforms according to the waveform of the driving signal. When printing data "0" is given to the switching circuit 43, the switching circuit 43 goes off, the application of the driving signal to the piezoelectric vibrator 21 is interrupted.

Thus, the driving signal is given selectively to each piezoelectric vibrator 21 according to the printing data. Thus, an ink particle can be jetted through the nozzle opening 17 or the meniscus of the ink in the nozzle opening 17 can be driven for minute vibrations.

Figure 6:
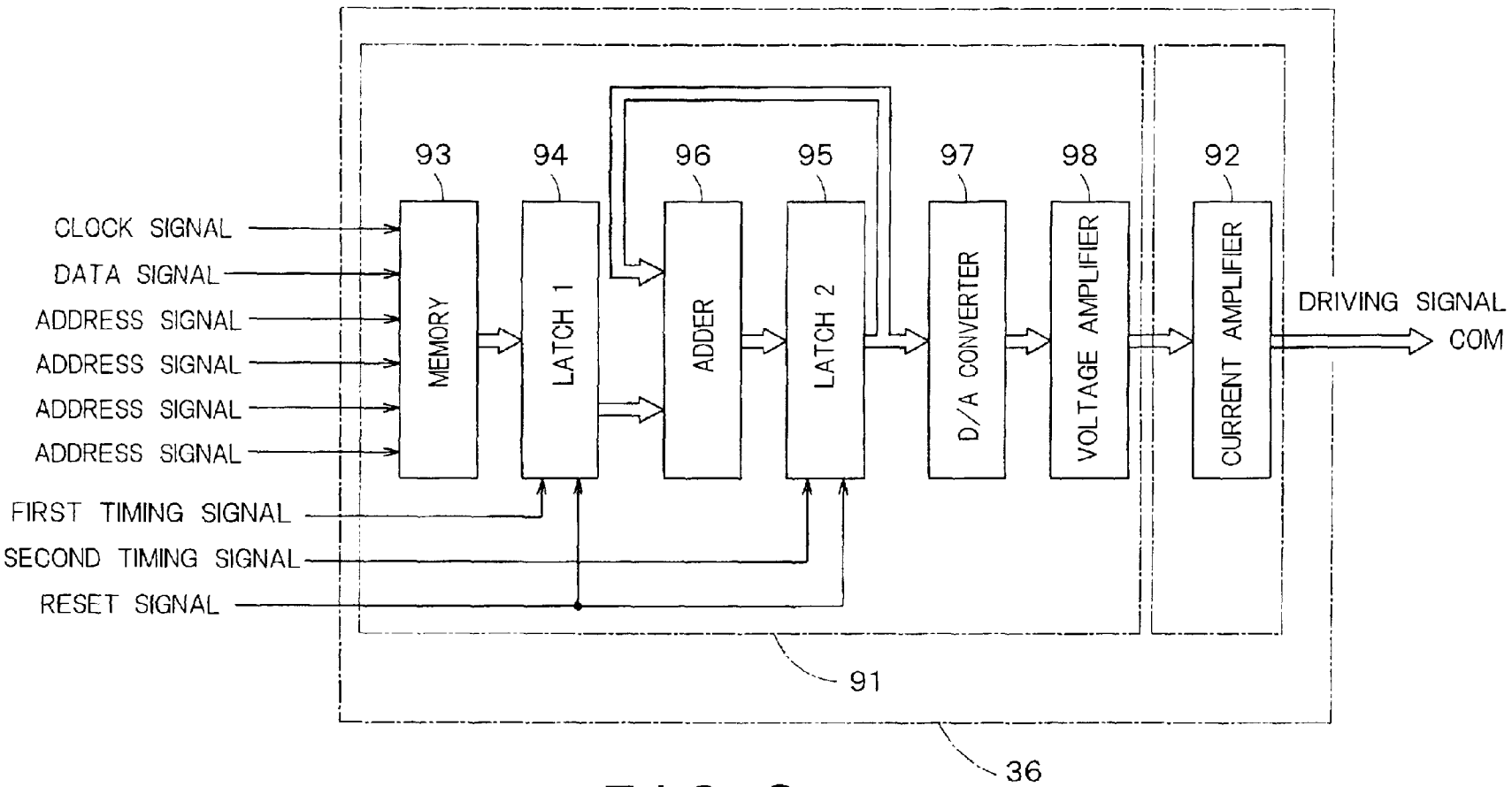
FIG. 6 is a block diagram of an important part of a driving signal generating circuit included in the ink-jet recording apparatus shown in FIG. 1.

FIG. 6 shows the driving signal generator 36 by way of example.

The driving-signal generator 36 comprises a waveform generator 92 and a current amplifier 92. The waveform generator 91 has a waveform memory 93, a first waveform-latching circuit 94, a second waveform-latching circuit 95, an adder 96, a digital-to-analog converter (D/A converter) 97 and a voltage amplifier 98.

The waveform memory 93 serves as a change data storage means for individually storing data on a plurality of voltage changes. The first waveform-latching circuit 94 is electrically connected to the waveform memory 93. The first waveform-latching circuit 94 latches data on a voltage change stored at a predetermined address in the waveform memory 93 in synchronism with a first timing signal. An output provided by the first waveform-latching circuit 94 and an output provided by the second waveform-latching circuit 95 are given to the adder 96. The second waveform-latching circuit 95 is electrically connected to the output of the adder 96. The adder 96 serves as a change data adding means. The adder 96 provides an output signal obtained by adding up the respective output signals of the waveform-latching circuits 94 and 95.

The second waveform-latching circuit 95 serves as an output data latching means for latching data (voltage information) provided by the adder 96 in synchronism with a second timing signal. The D/A converter 97 is electrically connected to the output of the second waveform-latching circuit 95 to convert an output signal provided by the second waveform-latching circuit 95 into a corresponding analog signal. The voltage amplifier 98 is electrically connected to the output of the D/A converter 97 to provide a driving voltage signal by amplifying the output analog signal of the D/A converter 97.

The current amplifier 92 is electrically connected to the output of the voltage amplifier 98 to provide a driving signal COM by current-amplifying the output signal of a voltage amplified by the voltage amplifier 98.

In the driving signal generator 36 of the foregoing configuration, a plurality of pieces of change data indicating voltage changes are stored individually in the storage region of the waveform memory 93 prior to the generation of a driving signal. For example, the control unit 11 gives the change data and address data corresponding to the change data to the waveform memory 93. Then, the waveform memory 93 stores the change data in a storage region specified by the address data. The change data includes sign information (increment/decrement information), and the address data is a 4-bit address signal.

The generation of a driving signal becomes possible after a plurality of kinds of change data have been stored in the waveform memory 93.

A driving signal is generated by holding the change data by the first waveform-latching circuit 94, and adding the change data held by the first waveform-latching circuit 94 to an output voltage provided by the second waveform-latching circuit 95 at an updating period.

A computer other than the control unit 11 is a host computer directly connected to the ink-jet recording apparatus or one of a plurality of computers interconnected by a network.

The application of driving signals to the piezoelectric vibrators 21 of the recording head 4 shown in FIG. 4 is controlled by the printing data. For example, the switching circuit 43 remains on and the driving signal COM is given to the piezoelectric vibrator 21 to deform the piezoelectric vibrator 21 while the printing data is "1". The switching circuit 43 remains off and the driving signal COM is not given to the piezoelectric vibrator 21 while the printing data is "0". While the printing data is "0", the piezoelectric vibrator 21 holds a charge given thereto immediately before the reception of the driving signal and maintains a deformed state created immediately before the reception of the driving signal.

Figure 7:
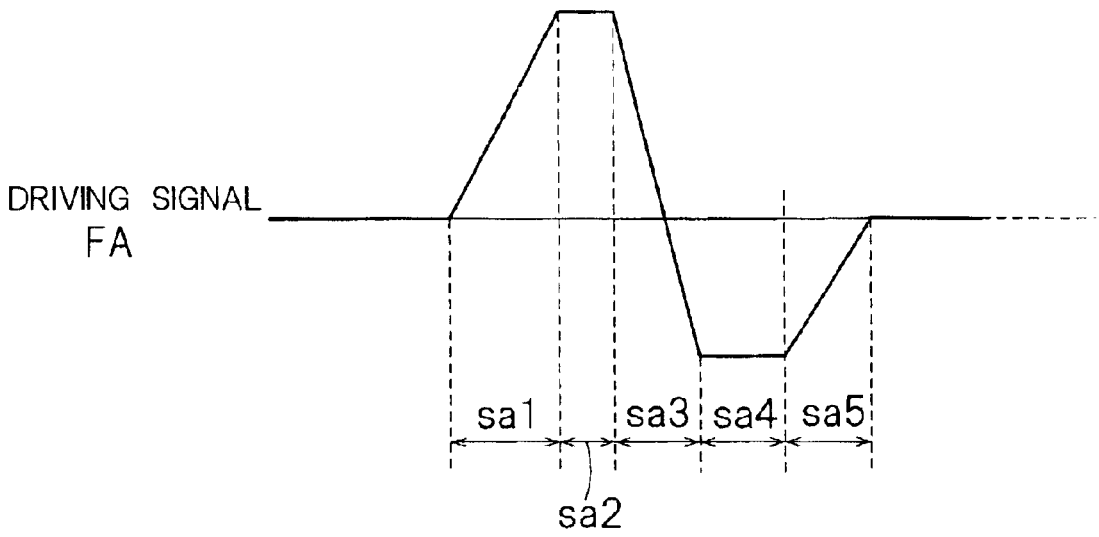
FIG. 7 is a diagram of a driving signal for a second flushing mode.
Figure 8:
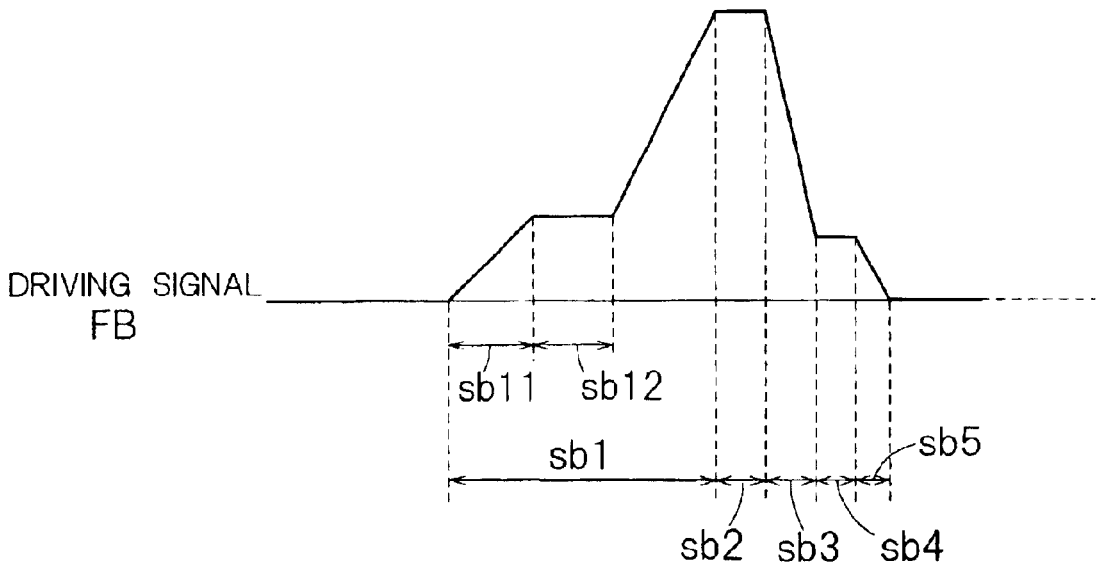
FIG. 8 is a diagram of a driving signal for a first flushing mode.

This embodiment is capable of executing a flushing operation in two modes. A second driving signal FA shown in FIG. 7 is given to each piezoelectric vibrator 21 for a normal flushing operation. A first driving signal FB shown in FIG. 8 is given to each piezoelectric vibrator 21 for a special flushing operation when the ink forming the meniscus is thickened un-uniformly. The driving signal generator 36 generates the second driving signal FA or the first driving signal FB.

The second driving signal FA and the first driving signal FB can be generated by the driving signal generator 36 by a conventional method of generating a driving signal of an ink-jetting waveform for jetting an ink particle for a recording operation.

Figure 12:
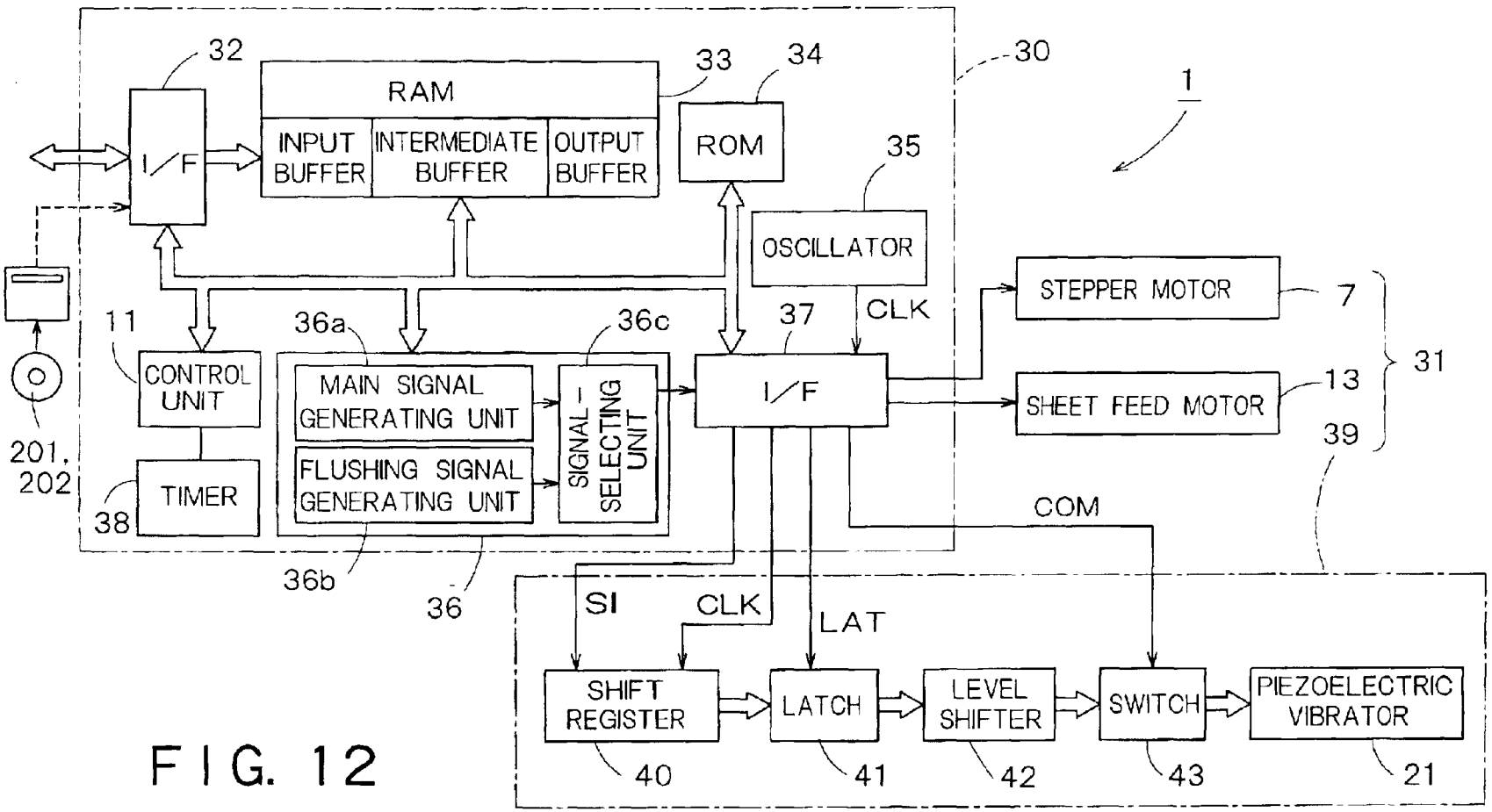
FIG. 12 is a block diagram of an ink-jet recording apparatus in another embodiment according to the present invention.

The driving signal generator 36 may comprise a main signal generating unit 36*a* that generates a driving signal of an ink-jetting waveform for jetting an ink particle for the recording operation, and a flushing signal generating unit 36*b* that generates the second driving signal FA or the first driving signal FB of waveforms different from the ink-jetting waveform as shown in FIG. 12. A signal-selecting unit 36*c* shown in FIG. 12 is a signal-selecting means. The driving signal generator 36 shown in FIG. 12 has an increased degree of freedom of designing the waveforms of the driving signals FA an FB, and the selection of either the second driving signal FA or the first driving signal FB.

The control unit 11 determines the driving signal to be given to each piezoelectric vibrator 21 for a flushing operation, i.e., the second driving signal FA or the first driving signal FB. The control unit 11 selects either the second driving signal FA or the first driving signal FB on the basis of a time measured by the timer 38; that is, the control unit 11 constitutes a mode control unit which determines a flushing mode on the basis of a time measured by the timer 38.

More concretely, the control unit gives each piezoelectric vibrator 21 the first driving signal FB for a flushing operation in a first flushing mode when a time measured by the timer 38 is in the range of a predetermined first time and a predetermined second time or gives each piezoelectric vibrator 21 the second driving signal FA for a flushing operation in a second flushing mode when a time measured by the timer 38 is outside the foregoing range. The predetermined first time and the predetermined second time are 2 min and 5 min, respectively, in this embodiment. However, the first and the second time may be properly changed.

As shown in FIG. 7, the second driving signal FA has a first voltage-raising part sa1 to apply a voltage to each of the piezoelectric vibrators 21 such that each of the pressure chambers 22 is expanded and the pressure in each of the pressure chambers 22 is reduced to a low pressure, a first voltage holding part sa2 to apply a voltage to each of the piezoelectric vibrator 21 such that each of the pressure chambers 22 is maintained at the low pressure, a first voltage-dropping part sa3 to apply a voltage to each of the piezoelectric vibrators 21 such that each of the pressure chambers 22 is contracted and the pressure in each of the pressure chambers 22 is raised to a high pressure, a second voltage-holding part sa4 to apply a voltage to each of the piezoelectric vibrators 21 such that each of the pressure chambers 22 is maintained at the high pressure, and a second voltage-raising part sa5 to apply a voltage to each of the piezoelectric vibrators 21 such that each of the pressure chambers 22 is restored to its original state.

As shown in FIG. 8, the first driving signal FB has a first voltage-raising part sb1 to apply a voltage to each piezoelectric vibrator 21 such that the pressure chamber 22 is expanded and the pressure in the pressure chamber 22 is reduced to a low pressure, a first voltage holding part sb2 to apply a voltage to the piezoelectric vibrator 21 such that the pressure chamber 22 is maintained at the low pressure, a first voltage-dropping part sb3 to apply a voltage to the piezoelectric vibrator 21 such that the pressure chamber 22 is maintained at a slightly reduced pressure, a second voltage-holding part sa4 to apply a voltage to the piezoelectric vibrator 21 such that the pressure chamber 22 is maintained at the slightly reduced pressure; and a second voltage-raising part sa5 to apply a voltage to the piezoelectric vibrator 21 such that the pressure chamber 22 is restored to its original state.

The first voltage-raising part sb1 has an auxiliary voltage-maintaining part sb12 to apply a voltage to the piezoelectric vibrator 21 such that the pressure in the pressure chamber 22 is maintained temporarily at a moderately reduced pressure during the expansion of the pressure chamber 22 and the reduction of the pressure in the pressure chamber 22 to the low pressure. The driving voltage is raised to a level for the auxiliary voltage-maintaining part sb12 by an auxiliary voltage-raising part sb11. However, the auxiliary voltage-maintaining part sb12 is not the essential feature of the present invention.

Next, the operations of the ink-jet printer 1 is explained hereunder with reference to FIG. 2A, FIG. 2B, and FIG. 3.

When the ink-jet printer 1 is connected to a power source, an initializing operation is performed. Then, the recording head 4 is located at the waiting position as shown in FIG. 3(*a*). Printing data for one line is provided by the output buffer of the RAM 33, and then the recording head 4 performs a maintenance operation (recovery operation) before starting the recording operation to ensure its ability to jet ink particles.

For example, either a flushing operation or a minute vibration operation is executed selectively as the maintenance operation.

More concretely, the flushing operation forces the recording head discharge the ink toward the cap 15 in a region outside the recording region. Normally, the flushing operation is performed while the recording head 4 is held at the waiting position. The flushing operation removes the thickened ink in the nozzle openings 17 from the recording head 4 such that the normal ink fills the nozzle openings 17.

As mentioned above, the minute vibration operation varies the pressure in the pressure chambers 22 such that the meniscuses in the nozzle openings 17 are vibrated slightly without jetting the ink through the nozzle openings 17. In this embodiment, the minute vibration operation is performed while the recording head 4 is held at the waiting position and is moving in the acceleration range.

The recording head 4 in this embodiment performs the flushing operation in the following manner. The flushing operation uses the second driving signal FA for the second flushing mode shown in FIG. 7 except when time measured by the timer 38 is not between the predetermined first time (2 min) and the predetermined second time (5 min).

The flushing operation in the second flushing mode jets ink particles of 13 ng in weight continuously at a jetting speed of about 7 m/s. The shape of the meniscus varies as shown in FIG. 9 during the flushing operation in the second flushing mode.

When time measured by the timer 38 is in the range of the predetermined first time (2 min) and the predetermined second time (5 min), the flushing operation uses the first driving signal FB shown in FIG. 8 for the first flushing mode.

The flushing operation in the first flushing mode jets ink particles of 9 ng in weight continuously at a jetting speed of about 10 m/s. The shape of the meniscus varies as shown in FIG. 10 during the flushing operation in the second flushing mode.

Figure 9:
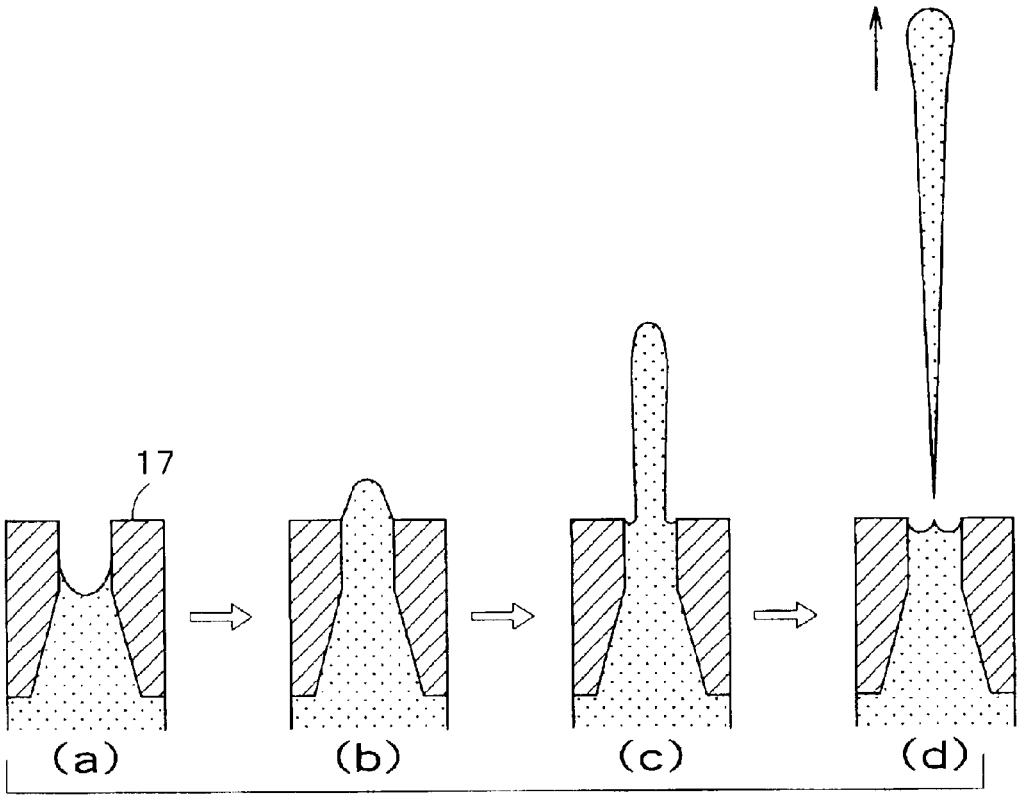
FIG. 9 is a view showing the variation of a meniscus when ink particle jetting is controlled by the driving signal shown in FIG. 7.
Figure 10:
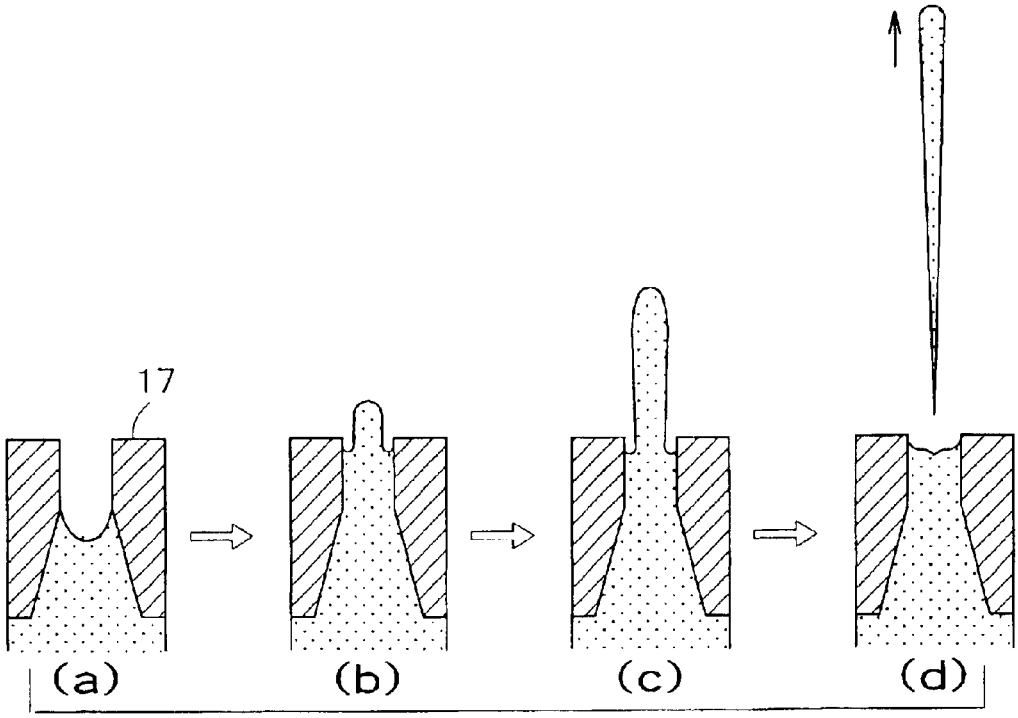
FIG. 10 is a view showing the variation of a meniscus when ink particle jetting is controlled by the driving signal shown in FIG. 8.

As shown in FIG. 10, the meniscus is made to recede greatly immediately before jetting an ink particle to make only the ink forming a central part of the meniscus is jetted as shown in FIG. 10(*b*) instead of jetting the ink forming the entire meniscus as shown in FIG. 9(*b*). Consequently, the direct influence of the thickened ink at the peripheral part of the nozzle openings 17 on jetting ink particles can be avoided and the flushing operation can be more satisfactorily achieve, and the meniscus is not broken even if the ink forming the meniscus is un-uniformly thickened.

The flushing operation in the first flushing mode is performed only when the time measured by the timer 38 is in the range of the predetermined first time (2 min) and the predetermined second time (5 min), because the flushing operation in the second flushing mode is able to jet more ink in a short time than the flushing operation in the first flushing mode and to exercise a great general flushing effect. Thus, the flushing operation in the second flushing mode is more preferable than the flushing operation in the first flushing mode except in cases where the flushing operation in the second flushing mode causes troubles.

In a modification of this embodiment, the control unit 11 may control the flushing operation such that the flushing operation uses the first driving signal FB in an initial stage of the flushing operation, and starts using the second driving signal FA a predetermined time after the start of the flushing operation.

Figure 11:
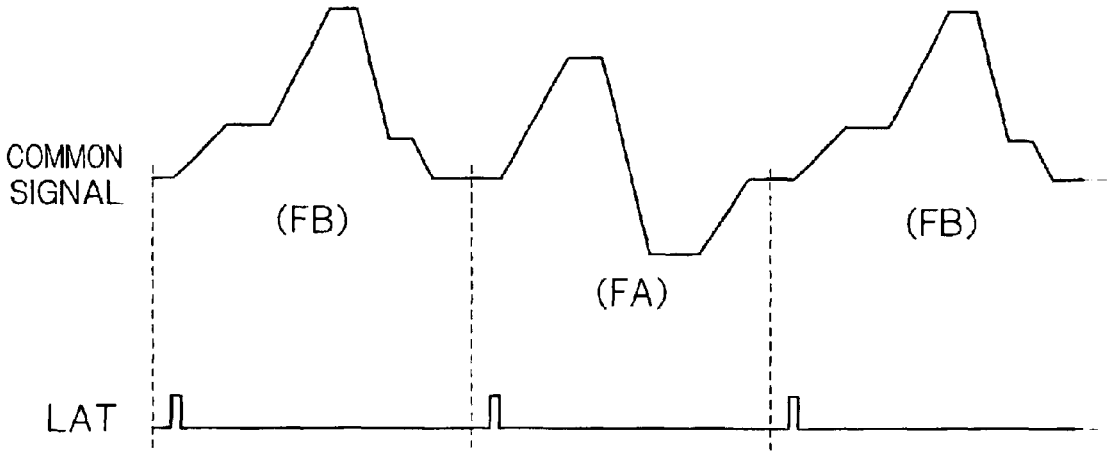
FIG. 11 is diagram showing a common driving signal including a waveform corresponding to the driving signal for the first flushing mode, and a waveform corresponding to the driving signal for the second flushing mode.

Preferably, the second driving signal FA and the first driving signal FB are selected from a common driving signal as shown in FIG. 11 by using a selection LAT pulse. The common driving signal has a waveform for jetting ink particles for the recording operation. For example, a driving signal of a waveform similar to that of the first driving signal FB, and having a part to apply a voltage lower by about 3

V than that of the corresponding part of the first driving signal FB to apply the voltage to the piezoelectric vibrator 21 such that the pressure chamber 22 is maintained at the low pressure may be used as a driving signal for jetting minute ink particles of 7 ng in weight at a jetting speed of 8 m/s.

The common driving signal shown in FIG. 11 may be a driving signal only for the flushing operation, including only the waveforms of the second driving signal FA and the first driving signal FB. Such a driving signal increases the degree of freedom of designing the waveforms of the driving signals FA an FB, and the selection of either the second driving signal FA or the first driving signal FB.

The second driving signal FA and the first driving signal FB may be individually generated. Preferably, the flushing operation in the first flushing mode jets ink particles, when the diameter of the nozzle openings is 25 $\mu$m, having a weight in the range of 8 to 10 ng at a jetting speed in the range of 9 to 15 m/s.

Various changes and variations are possible in the foregoing embodiment within the scope of the present invention.

The pressure-generating element for varying the volume of the pressure chamber 22 is not limited to the piezoelectric vibrator 21. For example, a magnetostrictive vibrator may be used for expanding and contracting the pressure chamber 22 to vary the pressure in the pressure chamber 22, or a heat-generating element may be used for expanding and contracting a bubble with heat to vary the pressure in the pressure chamber 22.

As mentioned above, the printer controller 30 may be a computer system. Programs to be executed by the computer system to achieve the foregoing functions may be stored in a recording medium 201 from which the computer is able to read information.

When the foregoing functions are realized by a program, such as an OS (operating system) that operates on the computer system, a program including instructions for controlling the program, such as the OS, may be stored in a recording medium 202.

The recording mediums 201 and 202 may be recognizable devices, such as floppy disks, or a network for transferring signals.

Although the invention has been described as applied to the ink-jet recording apparatus, the present invention is intended for application to various liquid-jetting apparatuses for jetting various liquids, such as glues and nail polishes.

According to the present invention, a liquid is jetted in small particles of a weight of 10 ng or below at a jetting speed of 8 m/s or above. When the small liquid particles are jetted in conformity with the foregoing control conditions, the receding of the meniscus after jetting a liquid particle can be satisfactorily suppressed, and the meniscus does not break even if the liquid forming the meniscus is un-uniformly thickened, which were verified by various experiments.

The present invention controls the liquid particle jetting operation so that the meniscus is retracted greatly immediately before jetting a liquid particle, and kinetic energy is concentrated on part of the liquid in a central part of the nozzle opening (central part of the meniscus). Thus sufficient kinetic energy can be given to the liquid particle. Since the liquid particle is jetted, destroying the film of the thickened liquid, the breakage of the meniscus can be prevented.

As apparent from the foregoing description, the flushing operation according to the present invention jets a liquid particle, overcoming a film of the thickened liquid and hence the meniscus does not break even if the liquid forming the meniscus is un-uniformly thickened. Thus, inclusion of bubbles in the liquid filling the nozzle opening can be prevented to ensure that the liquid particle can be properly jetted.

Since the present invention uses the individual driving signals for the flushing operation and the individual jetting signals, the degree of freedom of designing the driving signals for the flushing operation is increased remarkably and an optimum flushing operation can be realized.

An ink-jet recording apparatus in another embodiment according to the present invention and a method of driving the ink-jet recording apparatus will be described hereinafter.

The ink-jet recording apparatus in the present embodiment is similar in basic construction to the ink-jet recording apparatus in the first embodiment shown in FIGS. 1 to 6, and hence only parts of the ink-jet recording apparatus in the present embodiment different from those of the ink-jet recording apparatus in the first embodiment will be described. Reference will be made to FIGS. 1 to 6 when necessary.

The ink-jet recording apparatus in the present embodiment is capable of jetting a large ink particle for forming a large dot, a middle ink particle for forming a medium dot, and a small ink particle for forming a micro dot through the same nozzle opening 17.

Figure 13:
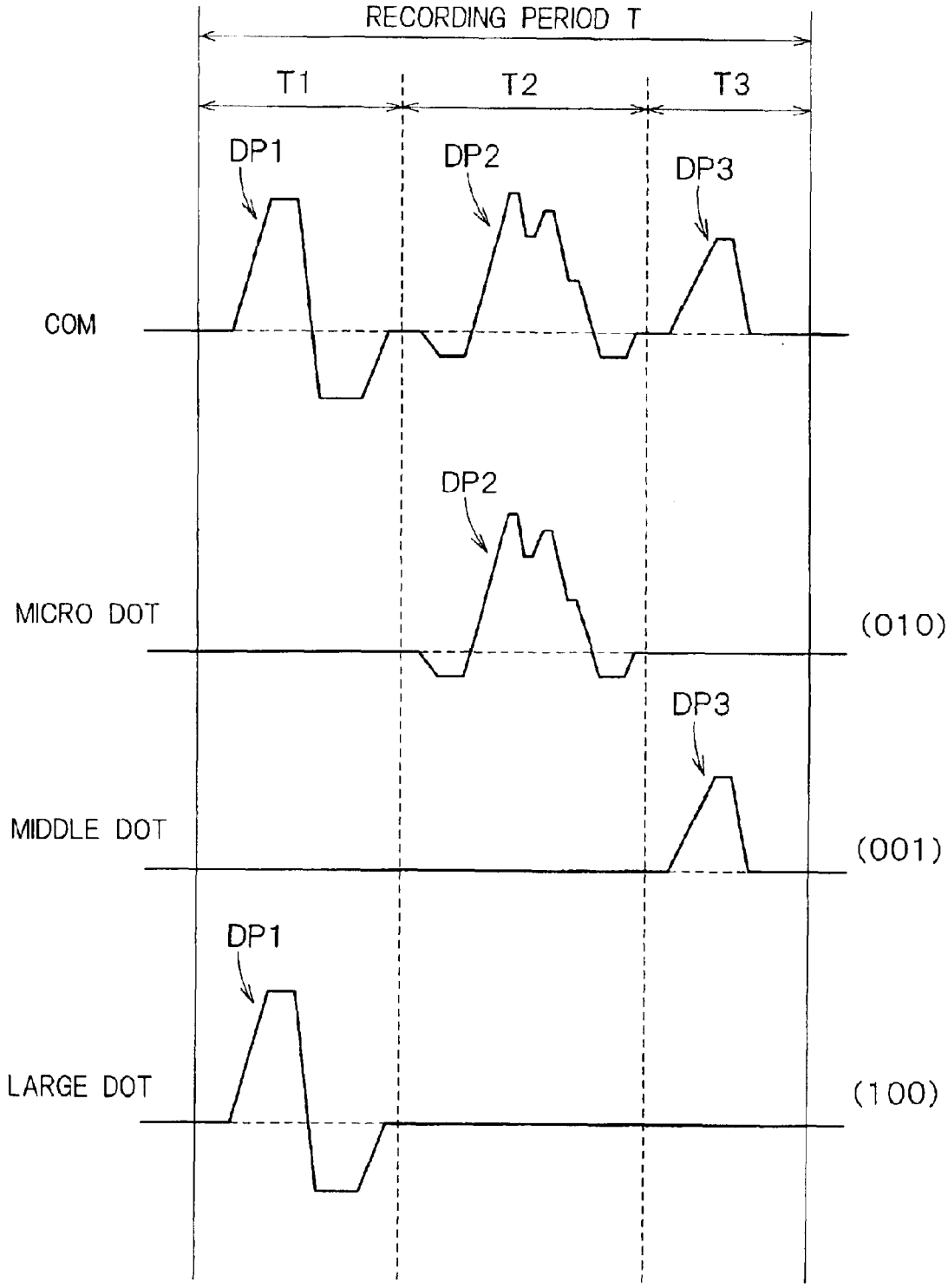
FIG. 13 is a diagram showing a driving signal and jetting pulses to be used by an embodiment of the present invention.

FIG. 13 shows a driving signal COM together with a second jetting signal (micro dot forming signal) DP2, a third jetting signal (middle dot forming signal) DP3 and a first jetting signal (large dot forming signal) DP1, which are chosen from the driving signal COM.

The driving signal COM consists of a sequential arrangement of the first jetting signal DP1, the second jetting signal DP2 and the third jetting signal DP3, as shown in FIG. 13.

A switching circuit 43 (FIG. 5) selects and sends the second jetting signal DP2 to a piezoelectric vibrator 21 to jet a small ink particle for forming a microdot. The switching circuit 43 selects and sends the third jetting signal DP3 to the piezoelectric vibrator 21 to jet a middle ink particle for forming a middle dot. The switching circuit 43 selects and sends the first jetting signal DP1 to the piezoelectric vibrator 21 to jet a large ink particle for forming a large dot.

As shown in FIG. 13, the second jetting signal DP2 for jetting a small ink particle for forming a micro dot has a waveform to carry out the steps of reducing the volume of a pressure chamber 22 (FIG. 4) slightly to a slightly reduced volume, maintaining the slightly reduced volume, continuously increasing the volume of the pressure chamber 22 to an increased volume, maintaining the increased volume, continuously reducing the volume of the pressure chamber 22 to a first moderately reduced volume, maintaining the first moderately reduced volume, continuously increasing the volume of the pressure chamber 22 to a moderately increased volume, maintaining the moderately increased volume, reducing the volume of the pressure chamber 22 to a second moderately reduced volume, maintaining the second moderately reduced volume, reducing the volume of the pressure chamber 22 to a further reduced volume, maintaining the further reduced volume, and slightly increasing the volume of the pressure chamber 22.

In the ink-jet recording apparatus (liquid-jetting apparatus) in the present embodiment, the plurality of jetting signals are used selectively to jet a ink particle of a desired volume selected from a plurality of ink particles respectively having different volumes through the same nozzle opening 17 (FIG. 4).

In this embodiment, a control unit 11 (FIG. 5) serves also as a flushing control unit that controls a recording head 4 for a flushing operation to remove a thickened ink from the nozzle opening 17 by jetting an ink particle through the nozzle opening 17.

The control unit 11 selects an optimum flushing mode from a plurality of flushing modes according to the degree of thickening of the ink in the nozzle opening 17. The degree of thickening of the ink in the nozzle opening 17 is determined from the duration of interruption of a printing operation.

The flushing modes include a flushing mode for a periodic flushing operation and a flushing mode for a power flushing operation that is executed when the printing operation is interrupted for a long time.

A cap 15 shown in FIG. 1 is brought into contact with the recording head 4 so as to cover a nozzle plate 16 provided with the nozzle openings 17 before starting the flushing operation. The control unit 11 selects an optimum flushing mode from a plurality of flushing modes respectively corresponding to different degrees of thickening of the ink in the nozzle openings 17. Then, ink particles are jetted through the nozzle openings 17 for the flushing operation in the optimum flushing mode. The ink jetted through the nozzle openings 17 for the flushing operation is caught by the cap 15.

In this embodiment, the control unit 11 makes the recording head 4 jet at least two kinds of ink particles respectively having different volumes among a plurality of ink particles respectively having different volumes in one cycle of the flushing operation.

The technical meaning of "one cycle of the flushing operation" will be explained. A thickening time, i.e., a time necessary for a liquid to thicken to a degree that affects adversely to jetting a liquid particle, is dependent on the type of the liquid and the condition of the environment. Usually, the thickening time is, for example, on the order of one second. Therefore, the liquid particles must be jetted successively for the flushing operation at jetting intervals shorter than the thickening time to prevent the thickening of the liquid during the flushing operation; that is, the extension of the jetting interval in the flushing operation beyond the thickening time signifies that the first cycle of the flushing operation was completed and the second cycle of the flushing operation has been started. Therefore, it is considered that "one cycle of the flushing operation" is continued as long as liquid particles are jetted continuously at jetting intervals shorter than the thickening time after the flushing operation has been started.

Moreover, when at least two kinds of liquid particles respectively having different volumes are jetted in "one cycle of the flushing operation, the kind of the liquid particle is changed in a time shorter than the thickening time.

Preferably, the two kinds of ink particles to be jetted in one cycle of the flushing operation include the smallest ink particle having the smallest volume among those of the plurality of kinds of ink particles respectively having the different volumes that can be jetted by the recording head 4, i.e., the small ink particle for forming the micro dot. More preferably, the small ink particle is jetted first in one cycle of the flushing operation.

When the small particle is jetted first in one cycle of the flushing operation, the thickened ink filling the nozzle opening 17 can be blown off gradually instead of blowing off all the thickened ink suddenly. Consequently, the ink is scarcely able to adhere to parts of the nozzle plate 16 around the nozzle openings 17 and hence the wet deviation of ink particles jetted immediately after the flushing operation can be prevented.

It is possible that the ink adheres to parts of the nozzle plate 16 around the nozzle openings 17, depending on the type and degree of thickening of the ink when large ink particles having a large volume are jetted in the last stage of the flushing operation. Therefore it is preferable to jet small ink particles in the last stage of one cycle of the flushing operation.

More preferably, small ink particles are jetted in the initial and the last stage of one cycle of the flushing operation, which is effective in achieving optimum flushing regardless of the type and the degree of thickening of the ink.

It is preferable that the largest ink particle having the largest volume among those of the plurality of kinds of ink particles that can be jetted by the recording head 4, and a middle ink particle or a small ink particle having a volume smaller than that of the largest ink particle are used in combination as the two kinds of ink particles respectively having different volumes.

The use of the large ink particle enhances the effect of the flushing operation and reduces time necessary for the flushing operation.

As apparent from the foregoing descriptions, the ink-jet recording apparatus in the present embodiment jets in one cycle of the flushing operation at least the two kinds of ink particles respectively having different volumes among the plurality of kinds of ink particles respectively having different volumes that can be jetted by the recording head 4. Therefore, the wet deviation of ink particles jetted immediately after the flushing operation can be prevented, and conditions of the flushing operation including effect and necessary time can be optimized.

An ink-jet recording apparatus in a modification of the ink-jet recording apparatus in the above-mentioned embodiment will be described with reference to FIG. 14.

Figure 14:
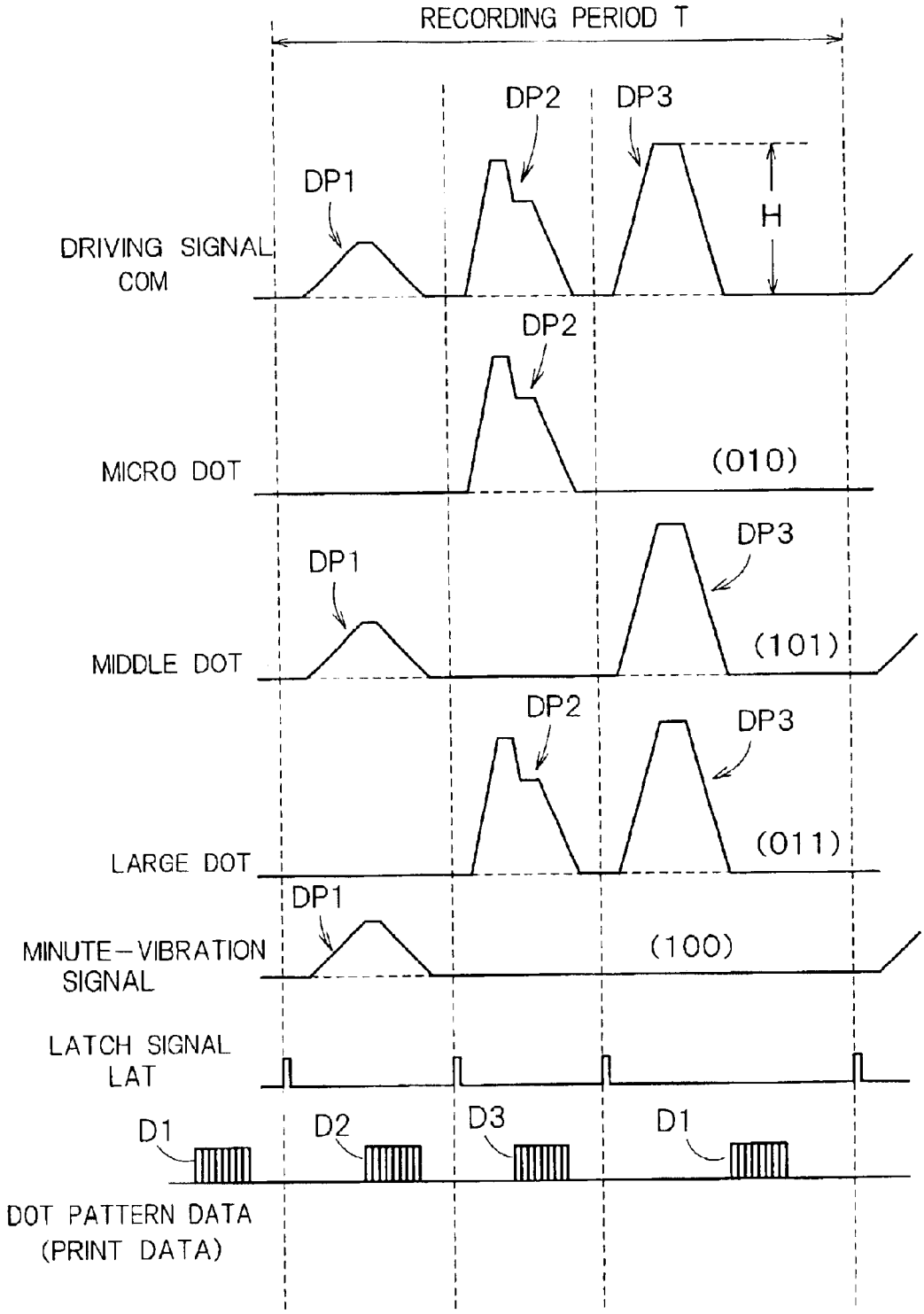
FIG. 14 is a diagram showing a driving signal and jetting pulses to be used by a modification of the embodiment of the present invention.

FIG. 14 shows a driving signal COM to be used by the ink-jet recording apparatus in the modification, including a small ink particle jetting signal for jetting a small ink particle for forming a microdot, a middle ink particle jetting signal for jetting a middle ink particle for forming a middle dot, a large ink particle jetting signal for jetting a large ink particle for forming a large dot, and a minute-vibration signal. The minute-vibration signal is a pulse signal to be applied to a piezoelectric vibrator 21 to vibrate the meniscus of the ink in the nozzle opening without causing the recording head 4 to jet any ink particle through the nozzle opening 17.

Referring to FIG. 14, a switching circuit 43 (FIG. 5) selects and sends a second jetting signal DP2 included in the driving signal COM to a piezoelectric vibrator 21 to jet a small ink particle for forming a micro dot. The switching circuit 43 selects and sends a first jetting signal DP1 and a third jetting signal DP3 to the piezoelectric vibrator 21 to jet a middle ink particle for forming a middle dot. The switching circuit 43 selects and sends the second jetting signal DP2 and the third jetting signal DP3 to the piezoelectric vibrator 21 to jet a large ink particle for forming a large dot. The switching circuit 43 selects and sends the first jetting signal included in the driving signal COM to the piezoelectric vibrator 21.

As shown in FIG. 14, the second jetting signal DP2 for jetting a small ink particle for forming a micro dot has a waveform to carry out the steps of continuously increasing the volume of a pressure chamber 22 (FIG. 4) to an increased volume, maintaining the increased volume, continuously reducing the volume of the pressure chamber 22 to a middle volume, maintaining the middle volume, and further continuously reducing the volume of the pressure chamber 22 to a small volume.

The ink-jet recording apparatus in the present embodiment is capable of selectively performing the flushing operation in a plurality of flushing modes according to the degree of thickening of the ink filling the nozzle openings 17, and jets at least two kinds of ink particles respectively having different volumes among a plurality of ink particles respectively having different volumes in one cycle of the flushing operation.

Preferably, the two kinds of ink particles to be jetted in one cycle of the flushing operation include the smallest ink particle having the smallest volume among those of the plurality of kinds of ink particles respectively having the different volumes that can be jetted by the recording head 4, i.e., the small ink particle for forming the micro dot, and more preferably, the small ink particle is jetted first in one cycle of the flushing operation.

When the small particle is jetted first in one cycle of the flushing operation, the thickened ink filling the nozzle opening 17 can be blown off gradually instead of blowing off all the thickened ink suddenly. Consequently, the ink is scarcely able to adhere to parts of the nozzle plate 16 around the nozzle openings 17 and hence the wet deviation of ink particles jetted immediately after the flushing operation can be prevented.

It is possible that the ink adheres to parts of the nozzle plate 16 around the nozzle openings 17, depending on the type and degree of thickening of the ink when large ink particles having a large volume are jetted in the last stage of the flushing operation. Therefore it is preferable to jet small ink particles in the last stage of one cycle of the flushing operation.

More preferably, small ink particles are jetted in the initial and the last stage of one cycle of the flushing operation, which is effective in achieving optimum flushing regardless of the type and the degree of thickening of the ink.

It is preferable that the largest ink particle having the largest volume among those of the plurality of kinds of ink particles that can be jetted by the recording head 4, and a middle ink particle or a small ink particle having a volume smaller than that of the largest ink particle are used in combination as the two kinds of ink particles respectively having different volumes.

The use of the large ink particle enhances the effect of the flushing operation and reduces time necessary for the flushing operation.

As apparent from the foregoing descriptions, the ink-jet recording apparatus in the modification of the above-mentioned embodiment, similarly to the foregoing embodiment, is capable of preventing the wet deviation of ink particles jetted immediately after the flushing operation, and of optimizing conditions of the flushing operation including effect and necessary time.

An ink-jet recording apparatus in still another embodiment according to the present invention and a method of driving the ink-jet recording apparatus will be described hereinafter.

The ink-jet recording apparatus in the present embodiment is similar in basic construction to the ink-jet recording apparatus in the above-mentioned embodiment shown in FIGS. 1 to 6, and hence only parts of the ink-jet recording apparatus in this embodiment different from those of the ink-jet recording apparatus in the above-mentioned embodiment will be described. Reference will be made to FIGS. 1 to 6 when necessary.

The ink-jet recording apparatus in the this embodiment is capable of jetting a large ink particle for forming a large dot, a middle ink particle for forming a medium dot, and a small ink particle for forming a micro dot through the same nozzle opening 17.

The present embodiment also uses the driving signal COM shown in FIG. 13 and including the jetting signals DP1, DP2 and DP3.

This ink-jet recording apparatus uses only ink particles excluding large ink particles among those that can be jetted by a recording head 4, namely, large ink particles for forming large dots, middle ink particles for forming middle dots, and small ink particles for forming micro drops for all the flushing operations in a plurality of flushing modes.

Preferably, ink particles used for the flushing operation has a volume equal to about half that of the large ink particle. More preferably, small ink particles having the smallest volume are used for the flushing operation.

Since large ink particles are not used in flushing operations of any flushing modes, the ink will not be scattered around and will not adhere to parts of nozzle plates 16 around nozzle openings 17. Therefore, even if the ink has a high pigment concentration and is prone to thicken, wet deviation of ink particles jetted by a recording operation immediately after the flushing operation can be prevented.

An ink-jet recording apparatus in a modification of the ink-jet recording apparatus in the above-mentioned embodiment uses a driving signal COM shown in FIG. 14 and including jetting signals DP1, DP2 and DP3.

This ink-jet recording apparatus also is capable of selectively performing the flushing operation in a plurality of flushing modes according to the degree of thickening of the ink filling the nozzle openings 17, and uses only ink particles excluding large ink particles among those that can be jetted by a recording head 4, namely, large ink particles for forming large dots, middle ink particles for forming middle dots, and small ink particles for forming micro drops, for all the flushing operations in a plurality of flushing modes.

The ink-jet recording apparatus in this modification, similarly to the foregoing embodiment, is capable of preventing the wet deviation of ink particles jetted immediately after the flushing operation.

Ink particles for the flushing operation may be jetted through the nozzle opening 17 for the flushing operation in any suitable jetting modes other than a jetting mode that continuously increases the volume of the pressure chamber 22 to an increased volume, maintains the increased volume, continuously reduces the volume of the pressure chamber 22 to a reduced volume, maintains the reduced volume and continuously increases the volume of the pressure chamber 22, which, typically, is the jetting mode for jetting a large ink particle for forming a large dot as shown in FIG. 13.

An ink-jet recording apparatus in still another embodiment according to the present invention and a method of driving the ink-jet recording apparatus will be described hereinafter.

The ink-jet recording apparatus in the this embodiment is similar in basic construction to the ink-jet recording apparatus in the above-mentioned embodiment shown in FIGS. 1 to 6, and hence only parts of the ink-jet recording apparatus in the present embodiment different from those of the ink-jet recording apparatus in the above-mentioned embodiment will be described.

The ink-jet recording apparatus in this embodiment is capable of jetting a large ink particle for forming a large dot, a middle ink particle for forming a medium dot, and a small ink particle for forming a micro dot through the same nozzle opening 17.

The ink-jet recording apparatus in this embodiment uses the driving signal COM including the jetting signals and the minute-vibration signal shown in FIG. 14.

This ink-jet recording apparatus has a control unit 11 (FIG. 5) including a cleaning control unit that controls a cleaning operation for forcibly sucking out the ink through the nozzle openings 17 of the recording head 4, and a flushing control unit that controls a flushing operation which controls piezoelectric vibrators 21 included in the recording head 4 to jet ink particles through the nozzle openings 17 into a non-recording region.

Figure 15:
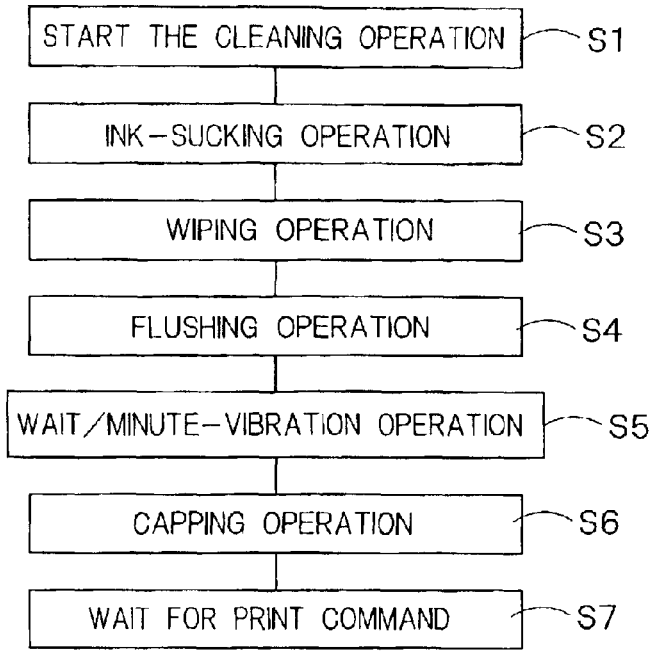
FIG. 15 is a flow chart of a cleaning operation to be carried out by the ink-jet recording apparatus shown in FIG. 1.

Referring to FIG. 15, the cleaning control unit starts a cleaning operation in step S1. A cap 15 is put on the recording head 4 so as to cover the nozzle plate 16 provided with the nozzle openings 17, and a vacuum pump connected to the cap 15 is actuated in step S2 to suck the ink forcibly through the nozzle openings 17 of the recording head 4.

Then, the cap 15 is separated from the recording head 4 and the surface of the nozzle plate 16 of the recording head 4 is cleaned by wiping with a wiper in step S3.

Then, the flushing control unit of the control unit 11 executes a flushing operation. After the cleaning control unit has completed the cleaning operation, the flushing control unit executes the flushing operation. In step S4, the flushing control unit makes a driving signal generator 36 generate a driving signal of a frequency other than the highest frequency among those of driving signals that can be generated by the driving signal generator 36 and makes the recording head 4 jet small ink particles having the smallest volume among those of a plurality of kinds of ink particles respectively having different volumes through the nozzle openings 17 for a flushing operation.

Preferably, the weight of the ink particles used for the flushing operation is in the range of 1 to 20 ng.

Preferably, the driving signal for the flushing operation has the lowest frequency among those of driving signals that can be generated by the driving signal generator 36, such as a driving signal used for high-quality printing. A special driving signal may be exclusively used for the flushing operation. Preferably, the frequency of the driving signal for the flushing operation is in the range of 0.1 to 3 kHz.

Preferably, at least 1000 ink particles are jetted through each nozzle opening 17 for the flushing operation.

The control unit 11 shown in FIG. 5 serves also as a minute-vibration control unit capable of controlling a minute-vibration operation for slightly vibrating the meniscuses of the ink in the nozzle openings 17. In step S5, the minute-vibration control unit applies a minute-vibration signal DP1 included in the driving signal shown in FIG. 14 generated by the driving signal generator 36 to each of piezoelectric vibrators 21 to vibrate the meniscus of the ink in each nozzle opening 17 without making the recording head 4 jet ink particles after the completion of the flushing operation.

The control unit 11 shown in FIG. 5 may include a stationary state control unit that holds the piezoelectric vibrators 21 in a stationary state for a predetermined time after the completion of the flushing operation. In step S6, the control unit 11 holds the piezoelectric vibrators 21 in a stationary state for, for example, one second or longer after the completion of the flushing operation.

The cap 15 is put on the recording head 4 in step S6 to cover the nozzle plate 16, and the control unit 11 waits for the next printing command in step S7.

As mentioned above, after the recording head 4 has been cleaned by the cleaning operation under the control of the cleaning control unit, a driving signal of a low frequency is applied to the piezoelectric vibrators 21 to jet ink particles other than the large ink particles, preferably, small ink particles, for a flushing operation. Therefore, the ink particles can be successively jetted without breaking the meniscus even if minute bubbles remain in the ink in the nozzle openings 17 and the meniscus is deformed after the cleaning operation.

Bubbles remaining in the ink in the nozzle openings 17 can be eliminated by the flushing operation executed in step S4 and, consequently, the meniscuses in the nozzle openings 17 are restored substantially to their normal state.

When step S5 for wait/minute-vibration operation is executed following step S4 for the flushing operation, minute bubbles remaining in the ink after the flushing operation dissolve in the ink and the meniscuses of the ink in the nozzle openings 17 recover their normal state.

As apparent from the foregoing descriptions, since the driving signal generator 36 generates the driving signal of a frequency other than the highest frequency among those of the driving signals that can be generated by the driving signal generator 36 after the completion of the cleaning operation, and small ink particles having the least volume among those of ink particles respectively having different volumes that can be jetted by the recording head 4 are jetted through the nozzle openings 17 for the flushing operation, minute bubbles remaining in the ink in the nozzle openings 17 after the cleaning operation can be eliminated without breaking the meniscuses of the ink in the nozzle openings 17. Thus, the shape of the meniscuses is restored to its normal state by the flushing operation and the wait/minute-vibration operation following the flushing operation, so that the following printing operation can be properly carried out without hindrance.

An ink-jet recording apparatus in a modification of the ink-jet recording apparatus in the above-mentioned embodiment will be described with reference to FIG. 16.

Figure 16:
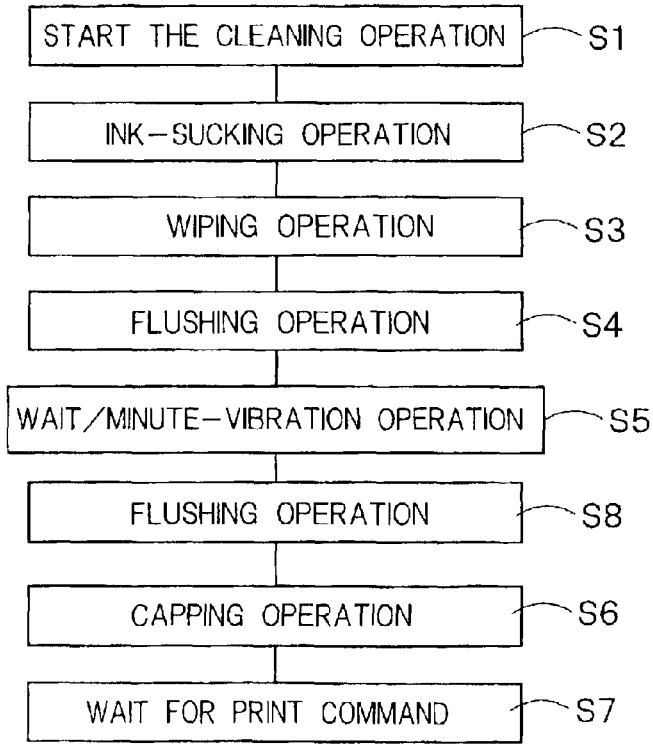
FIG. 16 is a flow chart of a cleaning operation in a modification of the cleaning operation shown in FIG. 15.

As shown in FIG. 16, a second flushing operation is executed in step S8 after the wait/minute-vibration operation in step S5 before executing step s6 for covering the nozzle plate 16 with the cap 15.

The driving signal generator 36 generates, for the second flushing operation to be executed in step S8, a driving signal of a frequency higher than that of the driving signal used by the flushing operation previously executed in step S4. In step S8, ink particles of a volume greater than that of the ink particle jetted for the flushing operation in step S8 are jetted through the nozzle openings 17 into the non-recording region for the second flushing operation.

Preferably, the second flushing operation (step S8) uses a driving signal of the highest frequency among those of driving signals that can be generated by the driving signal generator 36 to jet ink particles of the largest volume among those of ink particles that can be jetted by the recording head 4.

Minute bubbles have been eliminated from the ink in the nozzle openings 17 and the meniscuses of the ink in the nozzle opening 17 have been restored to their normal state by the flushing operation of step S4 and the wait/minute-vibration operation of step S5 before the second flushing operation is started in step S8. Therefore, the meniscuses are not broken even if large ink particles are jetted at a high frequency for the second flushing operation of step 8. The second flushing operation of step S8 using such large ink particles jetted at a high frequency is capable of quickly and surely removing the mixed ink adhering to the nozzle openings 17.

What is claimed is:

1. A liquid-jetting apparatus comprising:

a liquid-jetting head provided with nozzle openings and capable of jetting liquid particles through the nozzle openings; and a recovering unit to recover from a state of thickened liquid in the nozzle openings, the recovering unit including a flushing unit that carries out a flushing operation to jet the liquid in the nozzle openings in minute liquid particles, the minute liquid particle having a weight of less than 10 ng and being jetted at a jetting speed of 8 m/s or above.

2. The liquid-jetting apparatus according to claim 1, wherein the liquid-jetting head has pressure chambers respectively communicating with the nozzle openings and containing the liquid, and pressure generating means to vary pressure in the pressure chambers to jet liquid particles through the nozzle openings; and wherein the flushing unit has a driving unit to drive the pressure generating means for the flushing operation.

3. The liquid-jetting apparatus according to claim 2, wherein the pressure generating means includes piezoelectric members capable of deforming the pressure chambers to jet liquid particles through the nozzle openings, and wherein the driving unit gives a driving signal to the piezoelectric member.

4. The liquid-jetting apparatus according to claim 1, wherein the flushing unit is capable of carrying out the flushing operation selectively in a first flushing mode or a second flushing mode, wherein the flushing operation of the first mode jets a minute liquid particle having a weight of less than 10 ng at a jetting speed of 8 m/s or above, and wherein the flushing operation of the second mode jets a minute liquid particle having a weight of 12 ng or above.

5. The liquid-jetting apparatus according to claim 1, wherein the liquid-jetting head is provided with pressure chambers respectively communicating with the nozzle openings and capable of containing the liquid, and pressure generating means driven by liquid-jetting signals to vary pressure in the pressure chambers such that the liquid particles are jetted through the nozzle openings, wherein the flushing unit drives the pressure generating means by a driving signal for flushing, and wherein the driving signal for flushing is generated independently of the liquid-jetting signal.

6. The liquid-jetting apparatus according to claim 5, wherein a meniscus of the liquid formed in the nozzle opening is retracted greatly immediately before the minute liquid particle is jetted by the flushing unit, and the minute liquid particle is jetted through a central part of the meniscus.

7. A liquid-jetting apparatus comprising:

a liquid-jetting head provided with nozzle openings and capable of jetting liquid particles through the nozzle openings;

a recovering unit to recover from a state of thickened in a liquid in the nozzle openings, the recovering unit comprising a flushing unit that carries out a flushing operation to jet the liquid in the nozzle openings in minute liquid particles, the minute liquid particle having a weight of 10 ng or below and being jetted at a jetting speed of 8 m/s or above, wherein the liquid-jetting head has pressure chambers respectively communicating with the nozzle openings and containing the liquid, and pressure generating means to vary pressure in the pressure chambers to jet liquid particles through the nozzle openings, wherein the flushing unit has a driving unit to drive the pressure generating means for the flushing operation, wherein the pressure generating means comprises piezoelectric members capable of deforming the pressure chambers to jet liquid particles through the nozzle openings, wherein the driving unit outputs a driving signal to the piezoelectric member, and wherein the driving signal given by the driving unit to the piezoelectric member comprises:

a first voltage-raising part to apply a voltage for expanding the pressure chamber so that the pressure in the pressure chamber is reduced to the piezoelectric member, a first voltage holding part to apply a voltage for maintaining the pressure chamber at a reduced pressure to the piezoelectric member, a first voltage-reducing part to apply a voltage for contracting the pressure chamber to raise the pressure in the pressure chamber to a slightly reduced pressure to the piezoelectric member, a second voltage holding part to apply a voltage for maintaining the pressure chamber at the slightly reduced pressure to the piezoelectric member, and a second voltage-reducing part to apply a voltage for setting the pressure chamber in its original state to the piezoelectric member.

8. The liquid-jetting apparatus according to claim 7, wherein the first voltage-raising part of the driving signal has an auxiliary voltage-maintaining part to apply a voltage to the piezoelectric member such that the pressure in the pressure chamber is maintained temporarily at a slightly or moderately reduced pressure during an expansion of the pressure chamber to reduce the pressure in the pressure chamber.

9. A liquid-jetting apparatus comprising:

a liquid-jetting head provided with nozzle openings and capable of jetting liquid particles through the nozzle openings;

a recovering unit to recover from a state of thickened liquid in the nozzle openings, the recovering unit comprising a flushing unit that carries out a flushing operation to jet the liquid in the nozzle openings in minute liquid particles, the minute liquid particle having a weight of 10 ng or below and being jetted at a jetting speed of 8 m/s or above, the flushing unit is capable of carrying out the flushing operation selectively in a first flushing mode or a second flushing mode;

a head moving mechanism to move the liquid-jetting head in a scanning direction;

a capping mechanism disposed in a head-moving range in which the liquid-jetting head is able to move and capable of covering the nozzle openings;

a timer for measuring a time elapsed after the nozzle openings have been covered with the capping mechanism; and a mode control unit to selectively determine the mode of the flushing operation based on the time measured by the timer, wherein the flushing operation of the first mode jets a minute liquid particle having a weight of 10 ng or below at a jetting speed of 8 m/s or above, and wherein the flushing operation of the second mode jets a minute liquid particle having a weight of 12 ng or above.

10. The liquid-jetting apparatus according to claim 9, wherein the flushing unit carries out the flushing operation in the first flushing mode only when the time measured by the timer is in a range of a predetermined first time and a predetermined second time, and carries out the flushing operation in the second flushing mode when the time measured by the timer is outside the range of the first time and the second time.

11. The liquid-jetting apparatus according to claim 10, wherein the first time is two minutes, and the second time is five minutes.

12. The liquid-jetting apparatus according to claim 9, wherein the flushing unit operates in the first flushing mode in an initial stage of the flushing operation, and starts operating in the second flushing mode a predetermined time after a start of the flushing operation.

13. The liquid-jetting apparatus according to claim 9, wherein the liquid-jetting head has pressure chambers respectively communicating with the nozzle openings and containing the liquid, and pressure generating means to vary pressure in the pressure chambers to jet the liquid particles through the nozzle openings;

the flushing unit has a driving unit to drive the pressure generating means;

the pressure generating means comprises piezoelectric members capable of deforming the pressure chambers to jet the liquid particles through the nozzle openings;

the driving unit outputs a first driving signal to the piezoelectric member for the flushing operation in the first flushing mode, and outputs a second driving signal to the piezoelectric member for the flushing operation in the second flushing mode; and the first driving signal and the second driving signal are made by selectively using parts of a common driving signal.

14. The liquid-jetting apparatus according to claim 13, wherein the first driving signal comprises:

a first voltage-raising part to apply a voltage to the piezoelectric member such that the pressure chamber is expanded and the pressure in the pressure chamber is reduced to a reduced pressure, a first voltage holding part to apply a voltage to the piezoelectric member such that the pressure chamber is maintained at the reduced pressure, a first voltage-reducing part to apply a voltage to the piezoelectric member such that the pressure chamber is contracted and the pressure in the pressure chamber is raised to a slightly reduced pressure, a second voltage holding part to apply a voltage to the piezoelectric member such that the pressure chamber is maintained at the slightly reduced pressure, and a second voltage-reducing part to apply a voltage to the piezoelectric member such that the pressure chamber is restored to its original state; and the second driving signal comprises:

a first voltage-raising part to apply a voltage to the piezoelectric vibrator such that the pressure chamber is expanded and the pressure in the pressure chamber is reduced to a low pressure, a first voltage holding part to apply a voltage to the piezoelectric vibrator such that the pressure chamber is maintained at the low pressure, a first voltage-reducing part to apply a voltage to the piezoelectric vibrator such that the pressure chamber is contracted and the pressure in the pressure chamber is raised to a high pressure, a second voltage-holding part to apply a voltage to the piezoelectric vibrator such that the pressure chamber is maintained at the high pressure, and a second voltage-raising part to apply a voltage to the piezoelectric vibrator such that the pressure chamber is restored to its original state.

15. A liquid-jetting apparatus comprising:

a liquid-jetting head provided with nozzle openings and capable of jetting liquid particles through the nozzle openings; and a recovering unit to recover from a thickened state in a liquid in the nozzle openings, the recovering unit including a flushing unit that carries out a flushing operation to jet the liquid in the nozzle openings in minute liquid particles, wherein a meniscus of the liquid formed in the nozzle opening is retracted greatly immediately before the minute liquid particle is jetted by the flushing unit, and the minute liquid particle is jetted through a central part of the meniscus.

16. A liquid-jetting apparatus comprising:

a liquid-jetting head provided with nozzle openings and pressure chambers respectively communicating with the nozzle openings, and capable of varying pressure applied to a liquid contained in the pressure chambers to jet liquid particles through the nozzle openings and of selectively jetting a plurality of kinds of liquid particles respectively having different volumes through each of the nozzle openings; and a flushing control unit capable of controlling a flushing operation such that the liquid-jetting head jets liquid particles through the nozzle openings to recover from a state of thickened liquid in the nozzle openings;

wherein the flushing control unit makes the nozzle opening jet at least two kinds of liquid particles among the plurality of kinds of liquid particles respectively having different volumes in one cycle of the flushing operation, wherein the two kinds of liquid particles to be jetted in one cycle of the flushing operation include a liquid particle having a smallest volume among those of the plurality of kinds of liquid particles respectively having different volumes, and wherein the liquid particle having the smallest volume is jetted first in one cycle of the flushing operation.

17. The liquid-jetting apparatus according to claim 16, wherein the liquid particle having the smallest volume is jetted at least twice in one cycle of the flushing operation, and the liquid particles having the smallest volume are jetted first and last, respectively, in one cycle of the flushing operation.

18. A method of driving a liquid-jetting apparatus having a liquid-jetting head provided with nozzle openings and pressure chambers respectively communicating with the nozzle openings, and capable of varying pressure applied to a liquid contained in the pressure chambers to jet liquid particles through the nozzle openings and of selectively jetting a plurality of kinds of liquid particles respectively having different volumes through each of the nozzle openings, and a flushing control unit capable of controlling a flushing operation such that the liquid-jetting head jets liquid particles through the nozzle openings to recover from a state of thickened liquid in the nozzle openings;

wherein the flushing operation is executed by the flushing control unit so that at least two kinds of liquid particles among the plurality of kinds of liquid particles respectively having different volumes are jetted in one cycle of the flushing operation, wherein the two kinds of liquid particles to be jetted in one cycle of the flushing operation include a liquid particle having a smallest volume among those of the plurality of kinds of liquid particles respectively having different volumes, wherein the liquid particle having the smallest volume is jetted first in one cycle of the flushing operation.

19. The method of driving a liquid-jetting apparatus according to claim 18, wherein the liquid particle having the smallest volume is jetted at least twice in one cycle of the flushing operation, and the liquid particles having the smallest volume are jetted first and last, respectively, in one cycle of the flushing operation.

20. A liquid-jetting apparatus comprising:

a liquid-jetting head provided with nozzle openings and pressure chambers respectively communicating with the nozzle openings, and capable of varying pressure applied to a liquid contained in the pressure chambers to jet liquid particles through the nozzle openings and of selectively jetting a plurality of kinds of liquid particles respectively having different volumes through each of the nozzle openings; and a flushing control unit capable of controlling a flushing operation such that the liquid-jetting head jets liquid particles through the nozzle openings to recover from a thickened state in a liquid in the nozzle openings;

wherein the flushing control unit is capable of selecting an optimum flushing mode among a plurality of flushing modes according to a degree of thickening of the liquid in the nozzle opening, and liquid particles among the plurality of kinds of liquid particles respectively having different volumes excluding a liquid particle having a largest volume are jetted for the flushing operation in any one of the plurality of flushing modes.

21. The liquid-jetting apparatus according to claim 20, wherein a volume of the liquid particle to be jetted for the flushing operation is about half a volume of the liquid particle having the largest volume among those of the plurality of kinds of liquid particles respectively having different volumes.

22. The liquid-jetting apparatus according to claim 20, wherein the liquid particle to be jetted for the flushing operation has a smallest volume among those of the plurality of kinds of liquid particles respectively having different volumes.

23. The liquid-jetting apparatus according to claim 20, wherein the liquid particles are jetted for the flushing operation by a jetting operation other than a jetting operation including steps of continuously expanding the pressure chamber to increase a volume of the pressure chamber, holding the pressure chamber in an expanded state, continuously contracting the pressure chamber to reduce the volume of the pressure chamber, holding the pressure chamber in a contracted state, and continuously expanding the pressure chamber.

24. The liquid-jetting apparatus according to claim 23, wherein the jetting operation of jetting the liquid particle for the flushing operation includes steps of continuously expanding the pressure chamber to increase the volume of the pressure chamber, holding the pressure chamber in an expanded state, continuously and moderately contracting the pressure chamber to reduce the volume of the pressure chamber to a middle reduced level, holding the pressure chamber in a moderately contracted state, and continuously and sufficiently contracting the pressure chamber to a greatest reduced level.

25. The liquid-jetting apparatus according to claim 23, wherein the jetting operation of jetting the liquid particle for the flushing operation includes steps of continuously expanding the pressure chamber to increase the volume of the pressure chamber, holding the pressure chamber in an expanded state, continuously and moderately contracting the pressure chamber to a moderately contracted state, holding the pressure chamber in the moderately contracted state, continuously expanding the pressure chamber again to an expanded state, holding the pressure chamber in the expanded state, contracting the pressure chamber again to a contracted state, holding the pressure chamber in the contracted state, and continuously expanding the pressure chamber again.

26. A method of driving a liquid-jetting apparatus having a liquid-jetting head provided with nozzle openings and pressure chambers respectively communicating with the nozzle openings, and capable of varying pressure applied to a liquid contained in the pressure chambers to jet liquid particles through the nozzle openings and of selectively jetting a plurality of kinds of liquid particles respectively having different volumes through each of the nozzle openings, and a flushing control unit capable of controlling a flushing operation such that the liquid-jetting head jets liquid particles through the nozzle openings to recover from a thickened state in a liquid in the nozzle openings, comprising:

selecting an optimum flushing mode among a plurality of flushing modes by the flushing control unit according to a degree of thickening of the liquid in the nozzle openings; and executing the flushing operation so that the liquid particles are jetted through the nozzle openings using a selected flushing mode;

wherein the liquid particles among the plurality of kinds of liquid particles respectively having different volumes excluding a liquid particle having a largest volume are jetted for the flushing operation in any one of the plurality of flushing modes.

27. The method of driving a liquid-jetting apparatus according to claim 26, wherein a volume of the liquid particle to be jetted for the flushing operation is about half a volume of the liquid particle having the largest volume among those of the plurality of kinds of liquid particles respectively having different volumes.

28. The method of driving a liquid-jetting apparatus according to claim 26, wherein the liquid particle to be jetted for the flushing operation is a liquid particle having a smallest volume among those of the plurality of kinds of liquid particles respectively having different volumes.

29. The method of driving a liquid-jetting apparatus according to claim 26, wherein the liquid particles are jetted for the flushing operation by a jetting operation other than a jetting operation including steps of continuously expanding the pressure chamber to increase a volume of the pressure chamber, holding the pressure chamber in an expanded state, continuously contracting the pressure chamber to reduce the volume of the pressure chamber, holding the pressure chamber in a contracted state, and continuously expanding the pressure chamber.

30. The method of driving a liquid-jetting apparatus according to claim 29, wherein the jetting operation of jetting the liquid particle for the flushing operation includes steps of continuously expanding the pressure chamber to increase the volume of the pressure chamber, holding the pressure chamber in an expanded state, continuously and moderately contracting the pressure chamber to reduce the volume of the pressure chamber to a middle reduced level, holding the pressure chamber in a moderately contracted state, and continuously and sufficiently contracting the pressure chamber to a greatest reduced level.

31. The method of driving a liquid-jetting apparatus according to claim 29, wherein the jetting operation of jetting the liquid particle for the flushing operation includes steps of continuously expanding the pressure chamber to increase the volume of the pressure chamber, holding the pressure chamber in an expanded state, continuously and moderately contracting the pressure chamber to a moderately contracted state, holding the pressure chamber in the moderately contracted state, continuously expanding the pressure chamber again to an expanded state, holding the pressure chamber in the expanded state, contracting the pressure chamber again to a contracted state, holding the pressure chamber in the contracted state, and continuously expanding the pressure chamber again.

32. A liquid-jetting apparatus comprising:

a liquid-jetting head provided with nozzle openings and pressure chambers respectively communicating with the nozzle openings, and capable of varying pressure applied to a liquid contained in the pressure chambers by pressure generating means to jet liquid particles through the nozzle openings, and of selectively jetting a plurality of kinds of liquid particles respectively having different volumes through each of the nozzle openings;

a driving signal generating unit capable of selectively generating driving signals respectively having different frequencies for driving the pressure generating means;

a cleaning control unit capable of carrying out a cleaning operation that draws out the liquid through the nozzle openings by suction; and a flushing control unit capable of carrying out a flushing operation that operates the pressure generating means such that the liquid-jetting head jets liquid particles through the nozzle openings into a non-recording region;

wherein, after a cleaning operation has been carried out by the cleaning control unit, the flushing control unit carries out a flushing operation by making the driving signal generating unit generate a driving signal of a frequency other than a highest frequency among those of the driving signals that can be generated by the driving signal generating unit to jet liquid particles having a smallest volume among those of the plurality of kinds of liquid particles respectively having different volumes.

33. The liquid-jetting apparatus according to claim 32, wherein the driving signal for driving the pressure generating means for the flushing operation has a lowest frequency among those of the driving signals that can be generated by the driving signal generating unit.

34. The liquid-jetting apparatus according to claim 32, wherein the driving signal for driving the pressure generating means for the flushing operation is used also for driving the pressure generating means in a high-quality recording mode.

35. The liquid-jetting apparatus according to claim 32, wherein the driving signal for driving the pressure generating means for the flushing operation is used exclusively for the flushing operation.

36. The liquid-jetting apparatus according to claim 32, wherein a frequency of the driving signal for driving the pressure generating means for the flushing operation is in a range of 0.1 to 3 kHz.

37. The liquid-jetting apparatus according to claim 32, wherein the liquid particle used for the flushing operation has a weight in a range of 1 to 20 ng.

38. The liquid-jetting apparatus according to claim 32, wherein each of the nozzle openings jets liquid particles 1000 times or above for the flushing operation.

39. The liquid-jetting apparatus according to claim 32 further comprising a minute-vibration control unit that applies a minute-vibration pulse by using a driving signal generated by the driving signal generating unit to the pressure generating means to vibrate a meniscus of the liquid in the nozzle opening for slight vibrations after completing the flushing operation.

40. The liquid-jetting apparatus according to claim 39, wherein, after the minute-vibration control unit has completed a minute-vibration operation, the flushing control unit makes the driving signal generating unit generate a driving signal of a frequency higher than that of the driving signal used for jetting the liquid particle having the smallest volume for flushing to jet a liquid particle having a volume larger than that of the liquid particle having the smallest volume through the nozzle opening into the non-recording region for a second flushing operation.

41. The liquid-jetting apparatus according to claim 40, wherein the second flushing operation uses a driving signal of the highest frequency among those of driving signals that can be generated by the driving signal generating unit to jet a liquid particle having a largest volume among those of the plurality of kinds of liquid particles respectively having different volumes through the nozzle opening.

42. The liquid-jetting apparatus according to claim 32 further comprising a stationary-state control unit capable of holding the pressure generating means in a stationary state for a predetermined time after completing the flushing operation.

43. The liquid-jetting apparatus according to claim 42, wherein the predetermined time is one second or longer.

44. A method of driving a liquid-jetting apparatus having a liquid-jetting head provided with nozzle openings, pressure chambers respectively communicating with the nozzle openings and pressure generating means capable of varying pressure applied to a liquid contained in the pressure chambers to jet liquid particles through the nozzle openings, and capable of selectively jetting a plurality of kinds of liquid particles respectively having different volumes through each of the nozzle openings, a driving signal generating unit to generate a driving signal for driving the pressure generating means, capable of selectively generating driving signals respectively having different frequencies, comprising:

a cleaning step of cleaning the nozzle openings by drawing out the liquid through the nozzle openings by suction; and a flushing step of, after completing the cleaning step, jetting liquid particles having a smallest volume among those of the plurality of kinds of liquid particles respectively having different volumes through the nozzle openings into a non-recording region for a flushing operation by making the driving signal generating unit generate a driving signal of a frequency other than a highest frequency among those of the driving signals that can be generated by the driving signal generating unit.

45. The method of driving a liquid-jetting apparatus according to claim 44, wherein the driving signal to be used for the flushing operation has a lowest frequency among those of the driving signals that can be generated by the driving signal generating unit.

46. The method of driving a liquid-jetting apparatus according to claim 44, wherein the driving signal to be used for the flushing operation is used also for driving the pressure generating means in a high-quality recording mode.

47. The method of driving a liquid-jetting apparatus according to claim 44, wherein the driving signal for driving the pressure generating means for the flushing operation is used exclusively for the flushing operation.

48. The method of driving a liquid-jetting apparatus according to claim 44, wherein the frequency of the driving signal for driving the pressure generating means for the flushing operation is in a range of 0.1 to 3 kHz.

49. The method of driving a liquid-jetting apparatus according to claim 44, wherein the liquid particle used for the flushing operation have a weight in a range of 1 to 20 ng.

50. The method of driving a liquid-jetting apparatus according to claim 44, wherein each of the nozzle openings jets liquid particles 1000 times or above for the flushing operation.

51. The method of driving a liquid-jetting apparatus according to claim 44 further comprising a minute-vibration step of applying a minute-vibration pulse by using a driving signal generated by the driving signal generating unit to the pressure generating means to vibrate a meniscus of the liquid in the nozzle opening for slight vibrations after completing the flushing operation.

52. The method of driving a liquid-jetting apparatus according to claim 51 further comprising a second flushing step of, after the minute-vibration step has been completed, making the driving signal generating unit generate a driving signal of a frequency higher than that of the driving signal used for jetting the liquid particle having the smallest volume for flushing to jet a liquid particle having a volume larger than that of the liquid particle having the smallest volume through the nozzle opening into the non-recording region.

53. The method of driving a liquid-jetting apparatus according to claim 52, wherein the second flushing step uses a driving signal of the highest frequency among those of driving signals that can be generated by the driving signal generating unit to jet a liquid particle having a largest volume among those of the plurality of kinds of liquid particles respectively having different volumes through the nozzle opening.

54. The method of driving a liquid-jetting apparatus according to claim 44 further comprising a stationary-state control step of holding the pressure generating means in a stationary state for a predetermined time after completing the flushing operation.

55. The method of driving a liquid-jetting apparatus according to claim 54, wherein the predetermined time is one second or longer.

* * * * *